US011016434B2

(12) United States Patent
Luo et al.

(10) Patent No.: US 11,016,434 B2
(45) Date of Patent: May 25, 2021

(54) FORCE RECEIVING PART AND TONER CARTRIDGE

(71) Applicant: Ninestar Corporation, Zhuhai (CN)

(72) Inventors: Qin Luo, Zhuhai (CN); Gerning Ding, Zhuhai (CN); Likun Zeng, Zhuhai (CN)

(73) Assignee: NINESTAR CORPORATION, Zhuhai (CN)

( * ) Notice: Subject to any disclaimer, the term of this patent is extended or adjusted under 35 U.S.C. 154(b) by 0 days.

(21) Appl. No.: 16/878,145

(22) Filed: May 19, 2020

(65) Prior Publication Data

US 2020/0278637 A1 Sep. 3, 2020

Related U.S. Application Data

(63) Continuation of application No. PCT/CN2018/116401, filed on Nov. 20, 2018, and a (Continued)

(30) Foreign Application Priority Data

Nov. 23, 2017 (CN) ..... 201721598738.8
Apr. 23, 2018 (CN) ..... 201820577103.8

(Continued)

(51) Int. Cl.
*G03G 21/16* (2006.01)
*G03G 15/08* (2006.01)

(52) U.S. Cl.
CPC ..... *G03G 21/1647* (2013.01); *G03G 15/0865* (2013.01); *G03G 21/1676* (2013.01)

(58) Field of Classification Search
CPC ..... G03G 21/1647; G03G 15/0865; G03G 21/1676
See application file for complete search history.

(56) References Cited

U.S. PATENT DOCUMENTS

2009/0042656 A1 2/2009 Takigawa et al.
2014/0169837 A1* 6/2014 Huang ..... G03G 15/0886 399/262
2015/0043944 A1* 2/2015 Yamamoto ..... G03G 21/1676 399/258

FOREIGN PATENT DOCUMENTS

CN 201107552 Y 8/2008
CN 201107555 Y 8/2008

(Continued)

OTHER PUBLICATIONS

The World Intellectual Property Organization (WIPO) International Search Report for PCT/CN2018/116401 dated Feb. 21, 2019 8 Pages (including translation).

(Continued)

*Primary Examiner* — Sandra Brase
(74) *Attorney, Agent, or Firm* — Anova Law Group, PLLC

(57) ABSTRACT

A force receiving part and a toner cartridge are provided in the present disclosure. The toner cartridge includes a toner cartridge body and the force receiving part. The force receiving part is configured to receive a force from the image forming device and transmit the force to the toner cartridge body. The force receiving part includes a moving element, a receiving element for receiving the force, and a transmission element for transmitting the force. After the toner cartridge is installed on the image forming device, the force receiving part provided in the present disclosure enables automatic generation of an outlet for flowing out the toner when in use and for preventing the toner from flowing out by closing the outlet when not in use, which prevents the contamination and damage due to the developer leakage in the toner cartridge.

19 Claims, 28 Drawing Sheets

Related U.S. Application Data continuation of application No. PCT/CN2019/083170, filed on Apr. 18, 2019.

(30) Foreign Application Priority Data

| | | |
|---|---|---|
| Apr. 24, 2018 | (CN) | 201820603345.X |
| May 3, 2018 | (CN) | 201820656245.3 |
| May 8, 2018 | (CN) | 201820689741.9 |
| Jun. 28, 2018 | (CN) | 201821014015.3 |

(56) References Cited

FOREIGN PATENT DOCUMENTS

| | | | |
|---|---|---|---|
| CN | 102331697 | A | 1/2012 |
| CN | 102393618 | A | 3/2012 |
| CN | 203561829 | | 4/2014 |
| CN | 104199264 | A | 12/2014 |
| CN | 105511246 | A | 4/2016 |
| CN | 106773568 | A | 5/2017 |
| CN | 106842875 | A | 6/2017 |
| CN | 206532083 | U | 9/2017 |
| CN | 207908865 | U | 9/2018 |
| JP | 2015180909 | A | 10/2015 |
| JP | 2016148783 | A | 8/2016 |

OTHER PUBLICATIONS

The World Intellectual Property Organization (WIPO) International Search Report for PCT/CN2019/083170 dated Jul. 23, 2019 6 Pages (including translation).

* cited by examiner

FORCE RECEIVING PART AND TONER CARTRIDGE

CROSS-REFERENCE TO RELATED APPLICATION

This application is a continuation application of PCT Patent Application No. PCT/CN2018/116401, filed on Nov. 20, 2018, which claims the priority of Chinese patent applications No. 201721598738.8, filed on Nov. 23, 2017 and No. 201821014015.3, filed on Jun. 28, 2018, and also of PCT Patent Application No. PCT/CN2019/083170, filed on Apr. 18, 2019, which claims the priority of Chinese patent applications No. 201820577103.8, filed on Apr. 23, 2018, No. 201820603345.X, filed on Apr. 24, 2018, No. 201820656245.3, filed on May 3, 2018, No. 201820689741.9, filed on May 8, 2018. The above enumerated patent applications are incorporated herein by reference in their entirety.

TECHNICAL FIELD

The present disclosure relates to the field of printing technology and, more particularly, relates to a force receiving part and a toner cartridge.

BACKGROUND

A toner cartridge is a replaceable consumable which is widely used in the field of electronic image forming. The toner cartridge is used in an image forming device to provide developer to the image forming device. The image forming device is a device which forms images on a recording material by an electrophotographic imaging processing technique, and may include, for example, an electrophotographic copier, a laser printer, an electrophotographic printer, a facsimile machine, and a word processor, and the like.

The existing toner cartridge may mainly include a cartridge body and a force receiving part. A large amount of developer is contained in the cartridge body having a column-structure. The force receiving part, which is connected to the cartridge body, may be disposed on a sidewall at one end of the cartridge body along the length direction. The force receiving part may receive a rotational driving force from the image forming device and then the rotational driving force may be transmitted to other parts of the toner cartridge, such that the toner cartridge may discharge the developer outwardly. The toner outlet, for discharging the developer, of the toner cartridge may be configured at or near the force receiving part.

The connecting portion between the existing image forming device and the toner cartridge may be a rotational driving force transmission part of the image forming device. A special structure may be disposed at the rotational driving force transmission part. A needle-like component may be at the center of the rotational driving force transmission part and may be coplanar with the opening of the rotational driving force transmission part. When the toner cartridge is installed on the image forming device, the rotational driving force transmission part may move along the direction toward the toner cartridge, and the needle-like component of the rotational driving force transmission part may deeply enter the inside of the force receiving part accordingly. Then, a pushing component around the inner wall of the rotational driving force transmission part may retract along the direction away from the toner cartridge, and then the image forming device may drag the toner cartridge to move along the direction away from the rotational driving force transmission part, such that the outlet on the toner cartridge may be opened and the developer may be discharged from the toner cartridge. When the image forming operation of the image forming device stops and the toner cartridge is uninstalled from the image forming device, the image forming device may drag the toner cartridge to move along the direction toward to the rotational driving force transmission part to close the outlet on the toner cartridge; the pushing component around the inner wall of the rotational driving force transmission part may push along the direction toward the toner cartridge; the rotational driving force transmission part may move along the direction away from the toner cartridge; and at this point, the toner cartridge may be removed. Due to poor structure design, non-proper use, unqualified production materials and the like of the existing toner cartridge, it may result in that the driving tooth structure in the existing toner cartridge may be locked with the internal engagement position of the image forming device, and the operation of the image forming device may have errors; it may also result in that the toner cartridge may have poor sealing, causing the developer in the toner cartridge to be leaked out to pollute the environment and affect image forming quality; and it may further result in that the rotational driving force transmission part may not be engaged with the force receiving part or may be easily disengaged after the engagement.

SUMMARY

The present disclosure provides a force receiving part and a toner cartridge, which may prevent the toner cartridge from leaking the developer stored in the toner cartridge during transportation and movement to cause environmental pollution.

The present disclosure provides a force receiving part. The force receiving part is used for a toner cartridge, which includes a toner cartridge body and detachably installed on an image forming device. The force receiving part includes a receiving element, including a receiving tooth, a support rod, and a transmission rod, and being capable of engaging with the image forming device, where the receiving tooth is configured to receive a force from the image forming device; the support rod is capable of inwardly deviating along a radial direction of a rotating axis of the toner cartridge body, wherein the receiving tooth is disposed at a free end of the support rod; and the transmission rod is capable of transmitting the force received by the receiving tooth from the image forming device to the toner cartridge body; and the force receiving part further includes a moving element, capable of moving relative to the support rod, where during a moving process of the moving element relative to the support rod, in at least one position the support rod is interacted with the moving element and the receiving element is unable to disengage from the image forming device.

Optionally, during the moving process of the moving element relative to the support rod, the support rod is unable to inwardly deviate along the radial direction of the rotating axis of the toner cartridge body in at least one position under action of the moving element.

Optionally, a first elastic element is disposed between the moving element and the receiving element; the moving element includes an abutting portion and a pushing portion; the image forming device is abutted against the pushing element and pushes the moving element to move along a direction of the rotating axis of the toner cartridge body; and the pushing element is abutted against the support rod.

Optionally, an anti-detachment trench is disposed on the support rod; the pushing element is located inside the anti-detachment trench; and the anti-detachment trench is capable of preventing the moving element from detaching from the force receiving part when the moving element moves relative to the support rod.

Optionally, the transmission rod is rigidly connected to the support rod; the force receiving part includes a transmission element; and the transmission element is connected to the toner cartridge body and abutted against the transmission rod, such that the transmission rod is capable of transmitting the force received by the receiving tooth from the image forming device to the toner cartridge body.

Optionally, a locking tooth is disposed on the transmission rod to prevent the receiving element from being detached and separated from the transmission element.

Optionally, the force receiving part includes a second elastic element which enables the support rod to be inwardly deviated relative to the radial direction of the rotating axis of the toner cartridge body.

Optionally, the second elastic element is a ring-shaped elastic element and abutted against the receiving tooth.

Optionally, the moving element includes a first moving element and a second moving element, and the first moving element and the second moving element are independent from each other.

The present disclosure further provides a force receiving part. One end of the force receiving part may be connected to the toner cartridge body and the other end of the force receiving part may be engaged with the rotational driving force transmission part of the image forming device, thereby transmitting the rotational driving force to the cartridge body. When the toner cartridge is in operation in the image forming device, the rotational driving force transmission part may be engaged with the force receiving part and the developer in the toner cartridge may enter the image forming device from the toner cartridge. When the toner cartridge is uninstalled from the image forming device, the developer in the toner cartridge may no longer enter the outside from the toner cartridge, which may prevent the toner cartridge from leaking the developer stored in the toner cartridge during transportation and movement to cause environmental pollution.

Optionally, the present disclosure further provides a force receiving part. The force receiving part may include a connecting portion, configured for connecting with the cartridge body; a driving head, configured to receive a force from an image forming device and transmit the force to the connecting portion; a rod which is capable of moving along a length direction of the toner cartridge body and is abutted against the driving head to fix the driving head relative to the connecting portion. One end of the second elastic element is connected to the connecting portion and the other end of the second elastic element is connected to the driving head; one end of the first elastic element is connected to the rod and the other end of the first elastic element is connected to the driving head. When the force receiving part is in a first position, the second elastic member has a tendency to push the driving head away from the toner cartridge body.

The present disclosure further provides a force receiving part. The force receiving part may include a connecting portion, configured for connecting with the cartridge body; a driving head, configured to receive a force from an image forming device and transmit the force to the connecting portion; a rod which is capable of moving along a length direction of the toner cartridge body and is abutted against the driving head to fix the driving head relative to the connecting portion. One end of the second elastic element is connected to the connecting portion and the other end of the second elastic element is connected to the driving head; one end of the third elastic element is connected to the connecting portion and the other end of the first elastic element is connected to the rod. When the force receiving part is in a first position, the second elastic member has a tendency to push the driving head away from the toner cartridge body.

The present disclosure further provides a force receiving part. The force receiving part may include a connecting portion, configured for connecting with the cartridge body; a driving head, configured to receive a force from an image forming device and transmit the force to the connecting portion; a rod which is capable of moving along a length direction of the toner cartridge body and is abutted against the driving head to fix the driving head relative to the connecting portion. One end of the second elastic element is connected to the connecting portion and the other end of the second elastic element is connected to the driving head; one end of the third elastic element is connected to the connecting portion and the other end of the first elastic element is connected to the rod; and one end of the first elastic element is connected to the rod and the other end of the first elastic element is connected to the driving head. When the force receiving part is in a first position, the second elastic member has a tendency to push the driving head away from the toner cartridge body.

The present disclosure further provides a toner cartridge, which includes the above-mentioned force receiving part.

The present disclosure provides a force receiving part and a toner cartridge. One end of the force receiving part may be connected to the toner cartridge body and the other end of the force receiving part may be engaged with the rotational driving force transmission part of the image forming device, thereby transmitting the rotational driving force to the cartridge body. When the toner cartridge is in operation in the image forming device, the rotational driving force transmission part may be engaged with the force receiving part and the developer in the toner cartridge may enter the image forming device from the toner cartridge. When the toner cartridge is uninstalled from the image forming device, the developer in the toner cartridge may no longer enter the outside from the toner cartridge, which may prevent the toner cartridge from leaking the developer stored in the toner cartridge during transportation and movement to cause environmental pollution.

The present disclosure further provides a toner cartridge which may use any above-mentioned force receiving part. When the toner cartridge is installed into the image forming device, the cooperation of the second elastic element and the first elastic element and/or the third elastic element may automatically open the toner cartridge; and when the toner cartridge is uninstalled from the image forming device, the toner cartridge may be automatically sealed, which may avoid the situation where the driving tooth structure of the toner cartridge and the internal engagement of the image forming device are locked in the existing technology, also reduce the possibility of errors in the operation of the machine and improve the tightness of the machine, and further effectively prevent the developer in the toner cartridge from leaking which may pollute the environment and affect the image forming quality.

DETAILED DESCRIPTION

The First Embodiment

Figure 1:
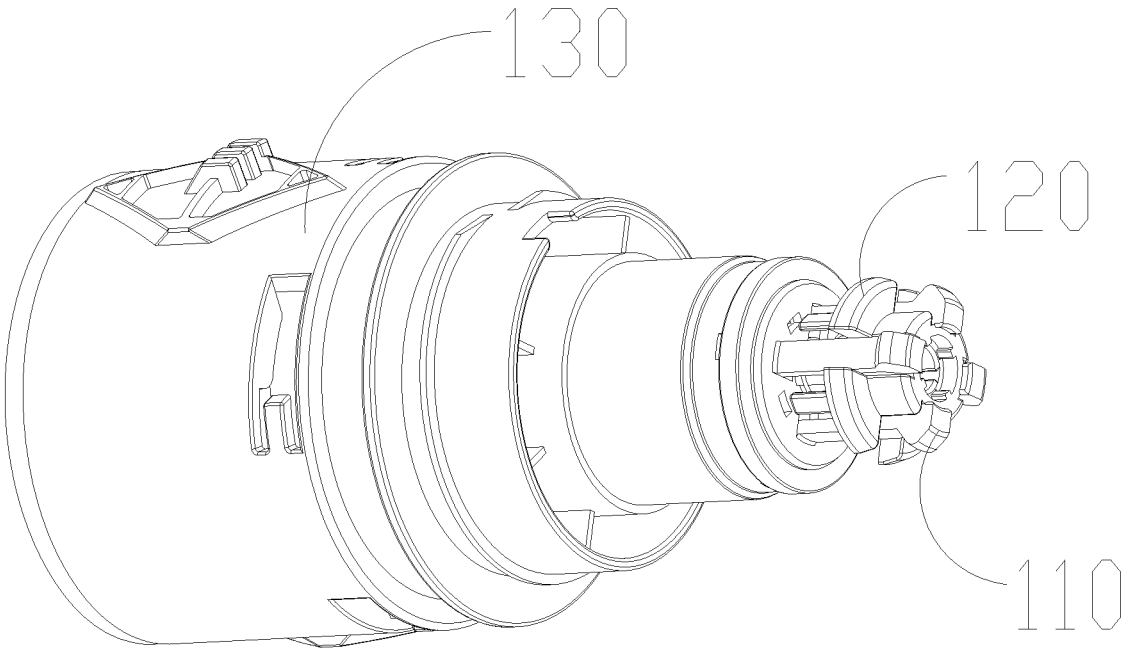
FIG. 1 illustrates a stereoscopic view of a force receiving part in the first embodiment.
Figure 2:
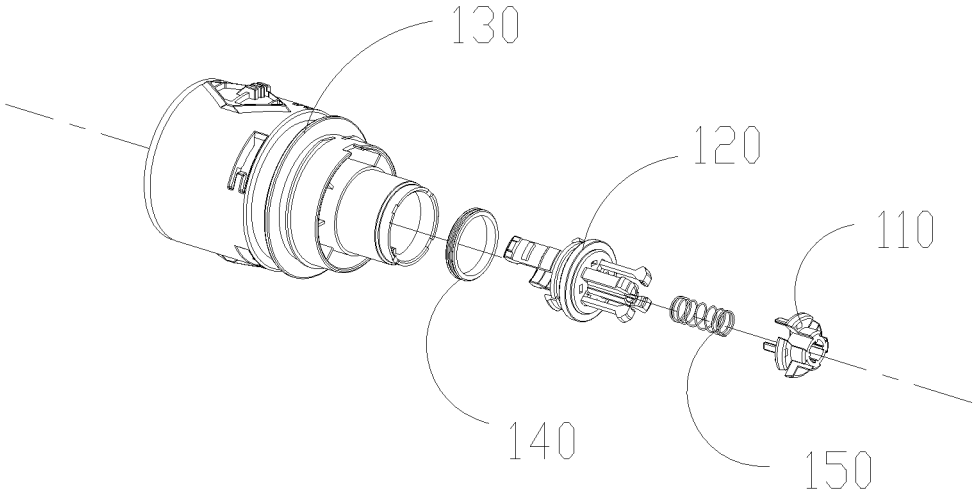
FIG. 2 illustrates an exploded view of parts of a force receiving part in the first embodiment.

A force receiving part is provided in one embodiment. Referring to FIG. 1 and FIG. 2, the force receiving part may include a moving element 110, a receiving element 120, a transmission element 130, and a first elastic element 150. Optionally, an elastic washer 140 may also be disposed at the force receiving part.

Figure 3:
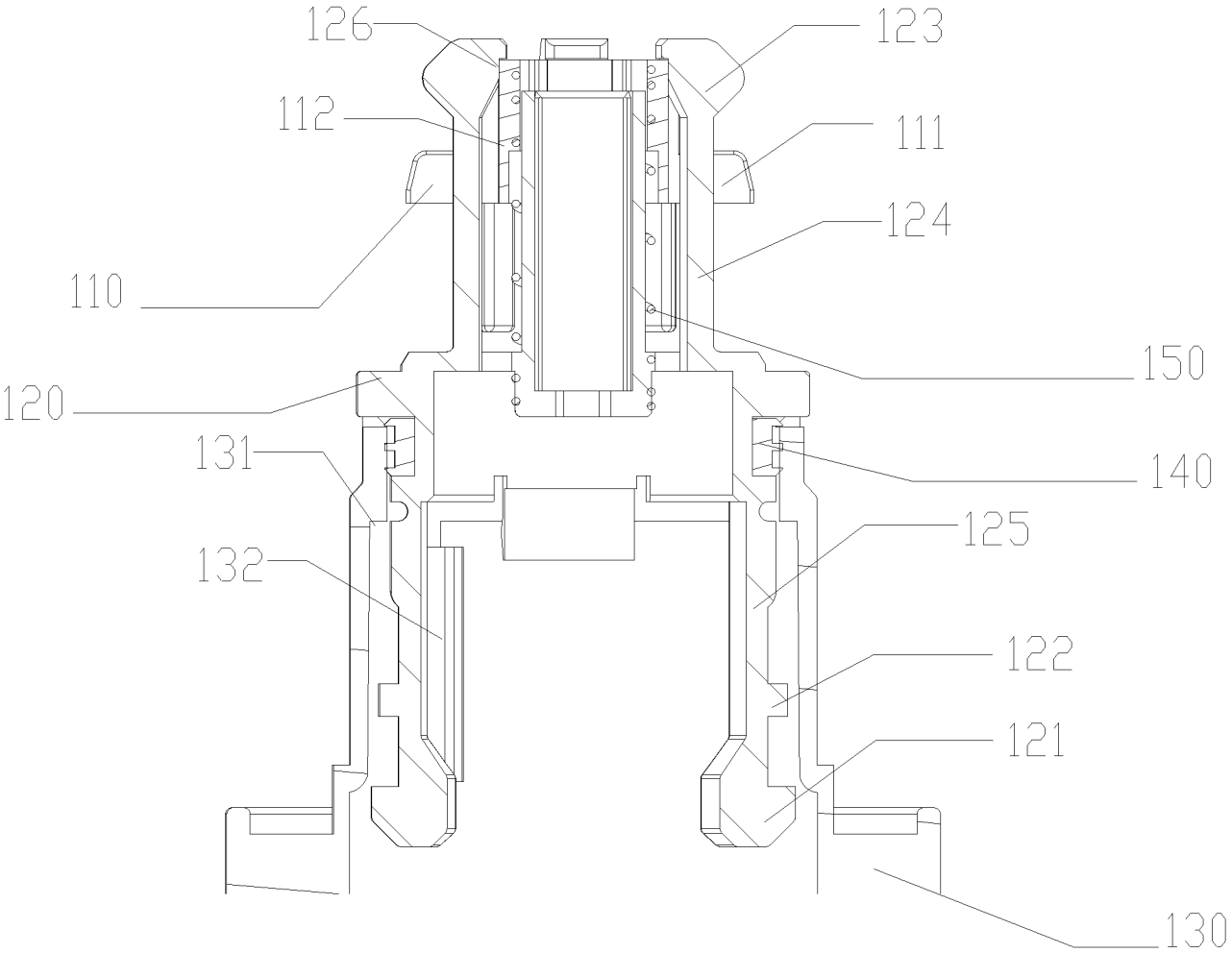
FIGS. 3-8 illustrate cross-sectional views of a force receiving part in different states along a cross-sectional plane of the toner cartridge body in the first embodiment.

As shown in FIG. 3, a protruding eave 131 and a protruding block 132 may be disposed on the transmission element 130. The transmission element 130 may be connected to the toner cartridge body. The inner wall of the toner cartridge body may be abutted against the outer wall of the transmission element 130 or the outer wall of the toner cartridge body may be abutted against the inner wall of the transmission element 130. The connection manner may include, but may not be limited to, existing technologies in the mechanical industry, such as thermoforming, gluing, riveting, and the like, which may not be described in detail herein.

A receiving tooth 123, a support rod 124, a transmission rod 125, an anti-detachment trench 126, a first locking tooth 122, and a second locking tooth 121 may be disposed at the receiving element 120, where the receiving tooth 123 may receive the rotational driving force from the image forming device; the support rod 124 may be elastic and inwardly deviated along the radial direction of the rotating axis of the toner cartridge body; the transmission rod 125 may be abutted against the protruding block 132, such that the rotational driving force is transmitted from the receiving element 120 to the transmission element 130, and further to the toner cartridge body; and the first locking tooth 122 and the second locking tooth 121 may be used to prevent the receiving element 120 from detaching from the transmission element 130. When the toner cartridge works normally in the image forming device, the first locking tooth 122 may be just abutted against the protruding eave 131 or the first locking tooth 122 has not be abutted against the protruding eave 131. The second locking tooth 121, a backup measure, may be used as a safety measure when the first locking tooth 122 breaks or the first locking tooth 122 is pulled out of the position, where the first locking tooth 122 is abutted against the protruding eave, with the receiving element 120; at this point, the second locking tooth 121 may be abutted against the protruding eave, preventing the entire receiving element 120 from being pulled out of the transmission element 130. Optionally, in order to ensure that the receiving element 120 and the transmission element 130 are separated smoothly, the first locking tooth 122 and the second locking tooth 121 may not interfere with other portions of the transmission element 130. Once a malfunction, that is, the entire receiving element 120 is pulled out of the transmission element 130, occurs in the image forming device, it may not only affect the current print quality, but also damage the inside of the image forming device, Meanwhile, if the damaged toner cartridge is not properly handled, it may also affect the health of users and even pollute air and water sources.

An abutting portion 111 and a pushing element 112 may be disposed at the moving element 110. The abutting portion 111 may be abutted against the image forming device to move the moving element 110 along the direction of the rotating axis of the toner cartridge. The height of the abutting portion 111 protruding along the radial direction of the rotating axis of the toner cartridge may be greater than the height of the receiving tooth 123 protruding along the radial direction of the rotating axis of the toner cartridge. The pushing element 112 may enter the anti-detachment trench 126. When the pushing element 112 is in the anti-detachment trench 126, due to the existence of the moving element 110, the support rod 124 may not be deviated inwardly along the radial direction of the rotating axis of the toner cartridge body.

A first elastic element 150 may be disposed between the first moving element 110 and the receiving element 120. Optionally, the first elastic element 150 may be a spring. The moving position of the moving element 110 may be restricted by the receiving element 120.

The process of installing the toner cartridge into the image forming device is described in detail hereinafter. A moving part 998 on the image forming device may be located inside the rotational driving force transmission part 999.

Figure 4:
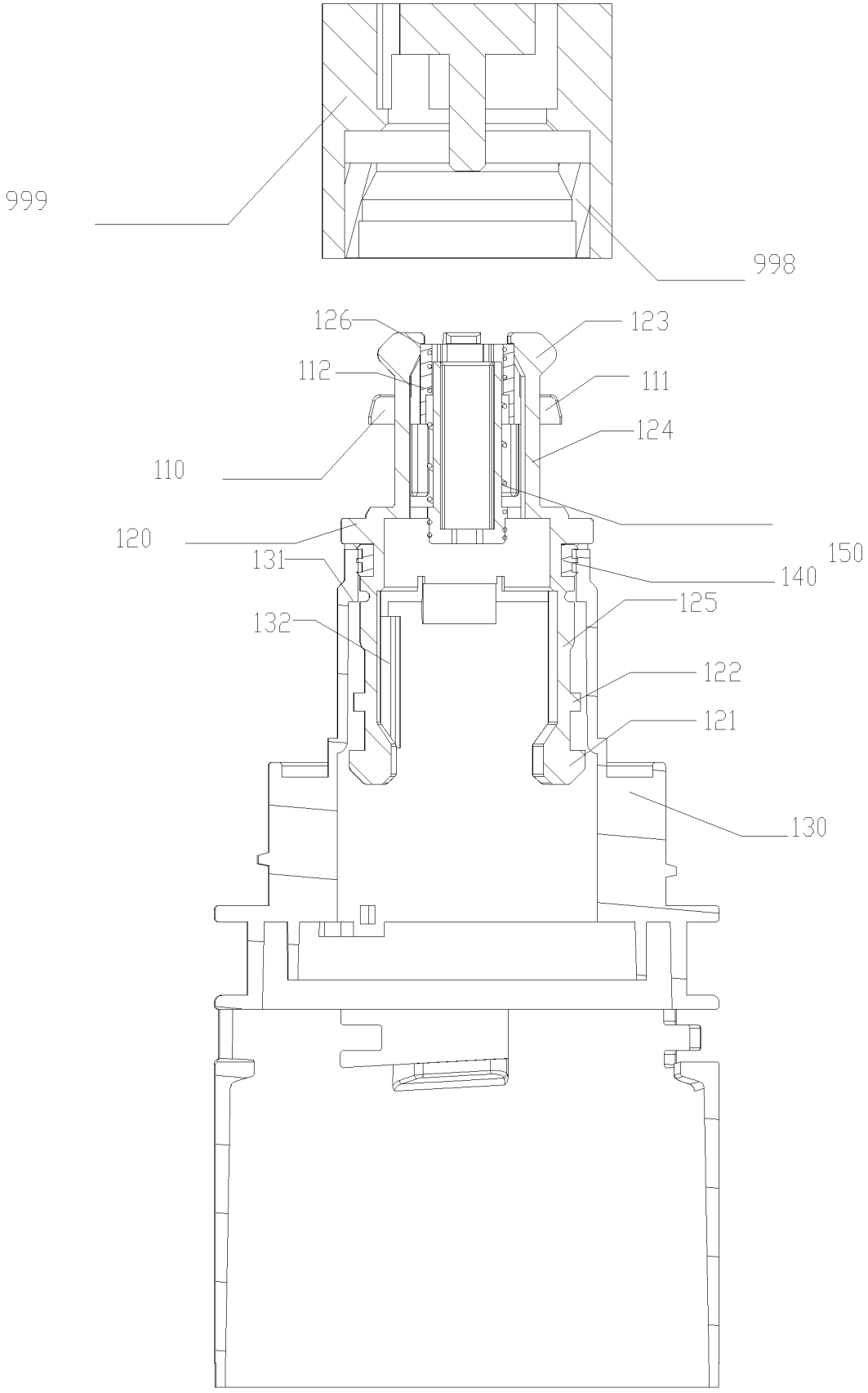

In the first step, as shown in FIG. 4, when the toner cartridge is not installed in the image forming device, the pushing element 112 of the force receiving part may be in the anti-detachment trench 126; at this point, the support rod 124 may not be inwardly deviated along the radial direction of the rotating axis of the toner cartridge body. The receiving element 120 and the transmission element 130 may be attached firmly to prevent the developer stored in the toner cartridge body from flowing out. Optionally, the elastic washer 140 may be also disposed between the receiving element 120 and the transmission element 130 to improve the sealing performance.

Figure 5:
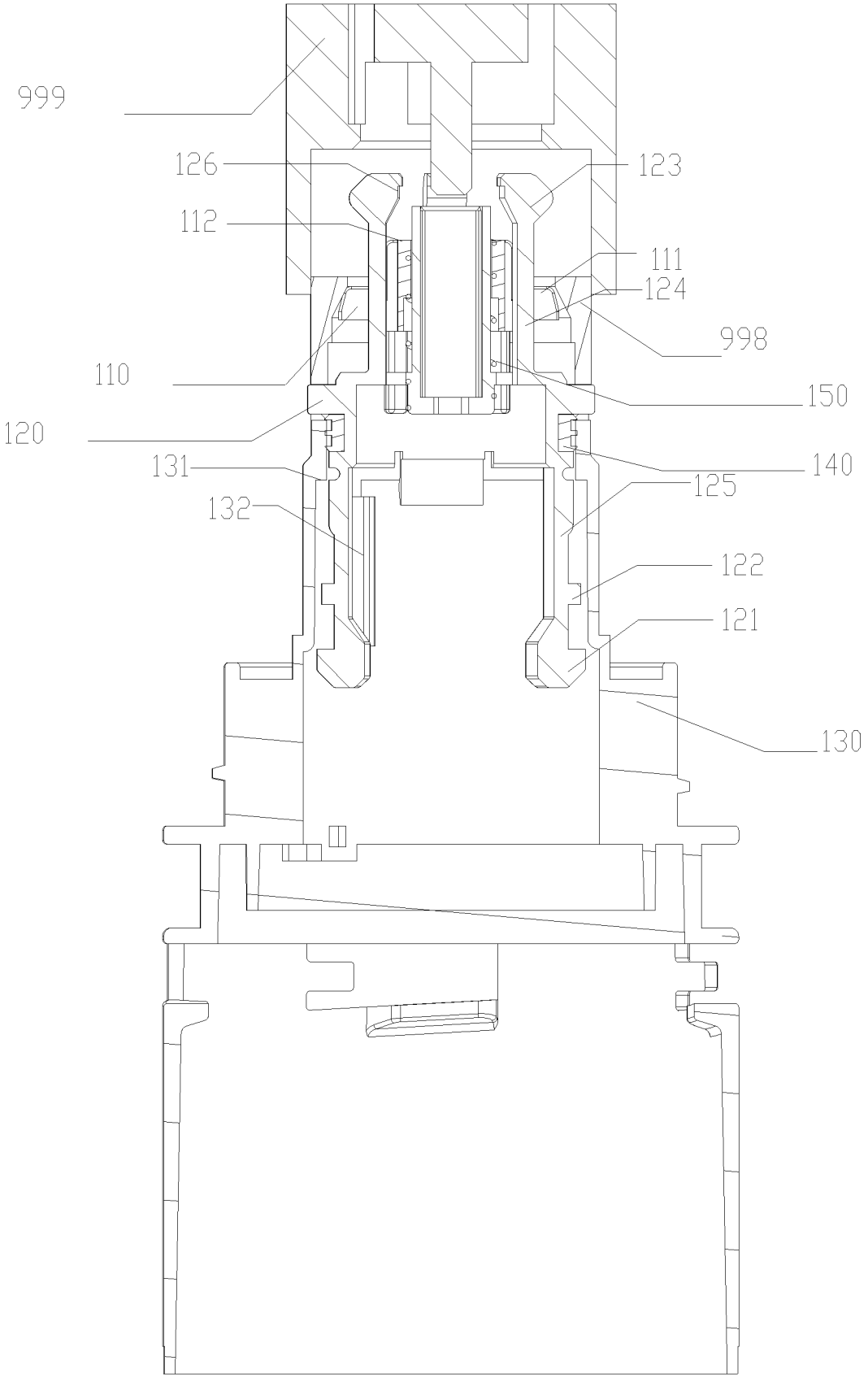

In the second step, after the toner cartridge is installed in the image forming device, since the radial distance between the abutting portion 111 and the rotating axis of the toner cartridge body is greater than the radial distance between the receiving tooth 123 and the rotating axis of the toner cartridge body, the moving part 998 of the image forming device may push the abutting portion 111 to move the moving element 110 along the direction of the toner cartridge body and the pushing element 112 may be detached from the anti-attachment trench 126, as shown in FIG. 5. At this point, the support rod 124 may be inwardly deviated along the radial direction of the rotating axis of the toner cartridge body.

In the third step, the rotational driving force transmission part 999 on the image forming device may move along the direction of the toner cartridge body. Due to the interference between the rotational driving force transmission part 999 and the driving tooth 123, the support rod may be inwardly deviated along the radial direction of the rotating axis of the toner cartridge body, and the receiving element 120 may be engaged with the rotational driving force transmission part 999, as shown in FIG. 6.

Figure 7:
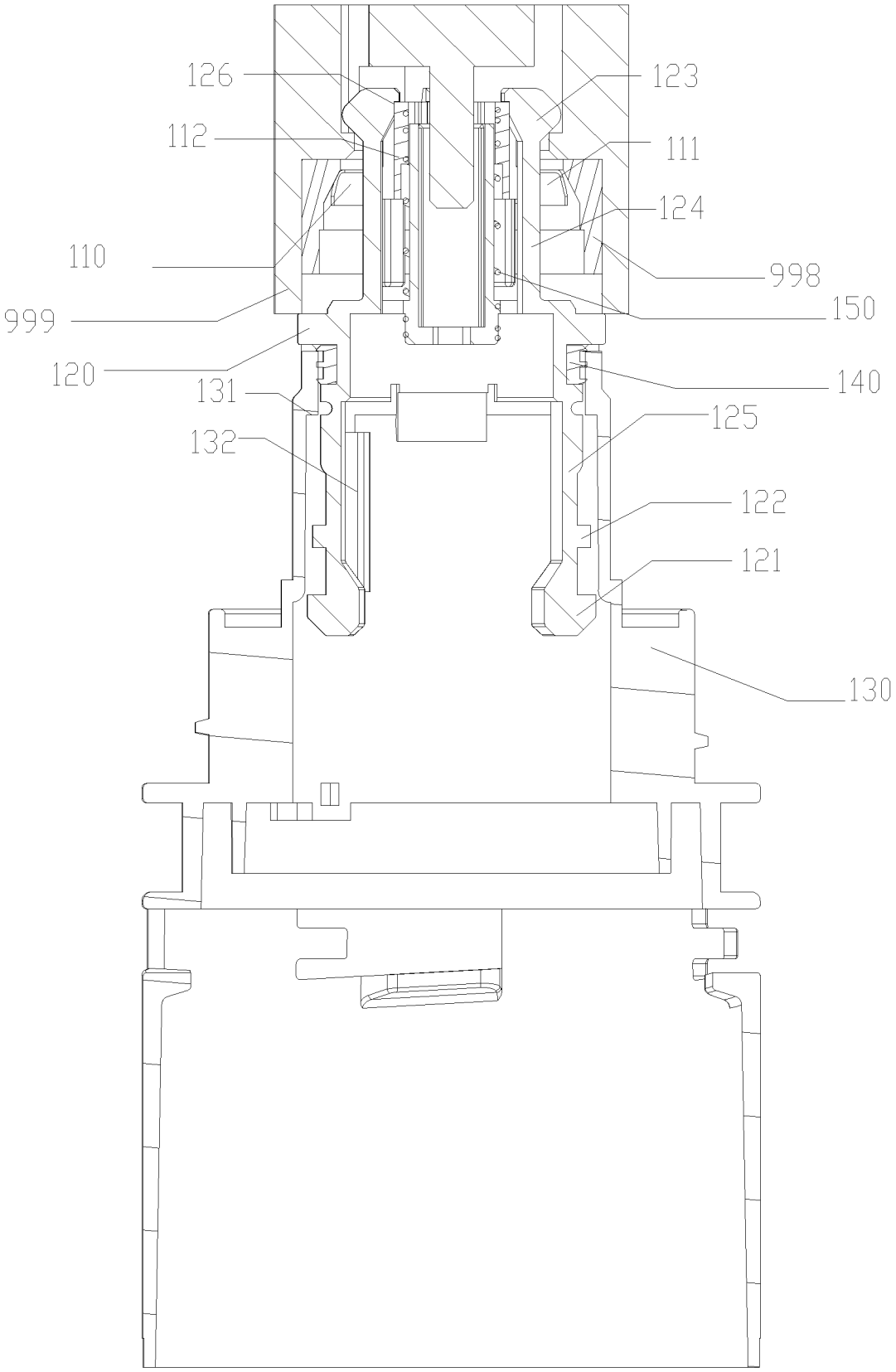

In the fourth step, the moving part 998 on the image forming device may move along the direction away from the toner cartridge body. Due to the existence of the first elastic element 150, the moving element 110 may follow the moving part 998 to move along the direction away from the toner cartridge body, until the pushing element 112 enters the anti-detachment trench 126, as shown in FIG. 7. At this point, since the support rod 124 is pressed and abutted against by the abutting portion 112, the support rod 124 may not be inwardly deviated along the radial direction of the rotating axis of the toner cartridge body.

Figure 8:
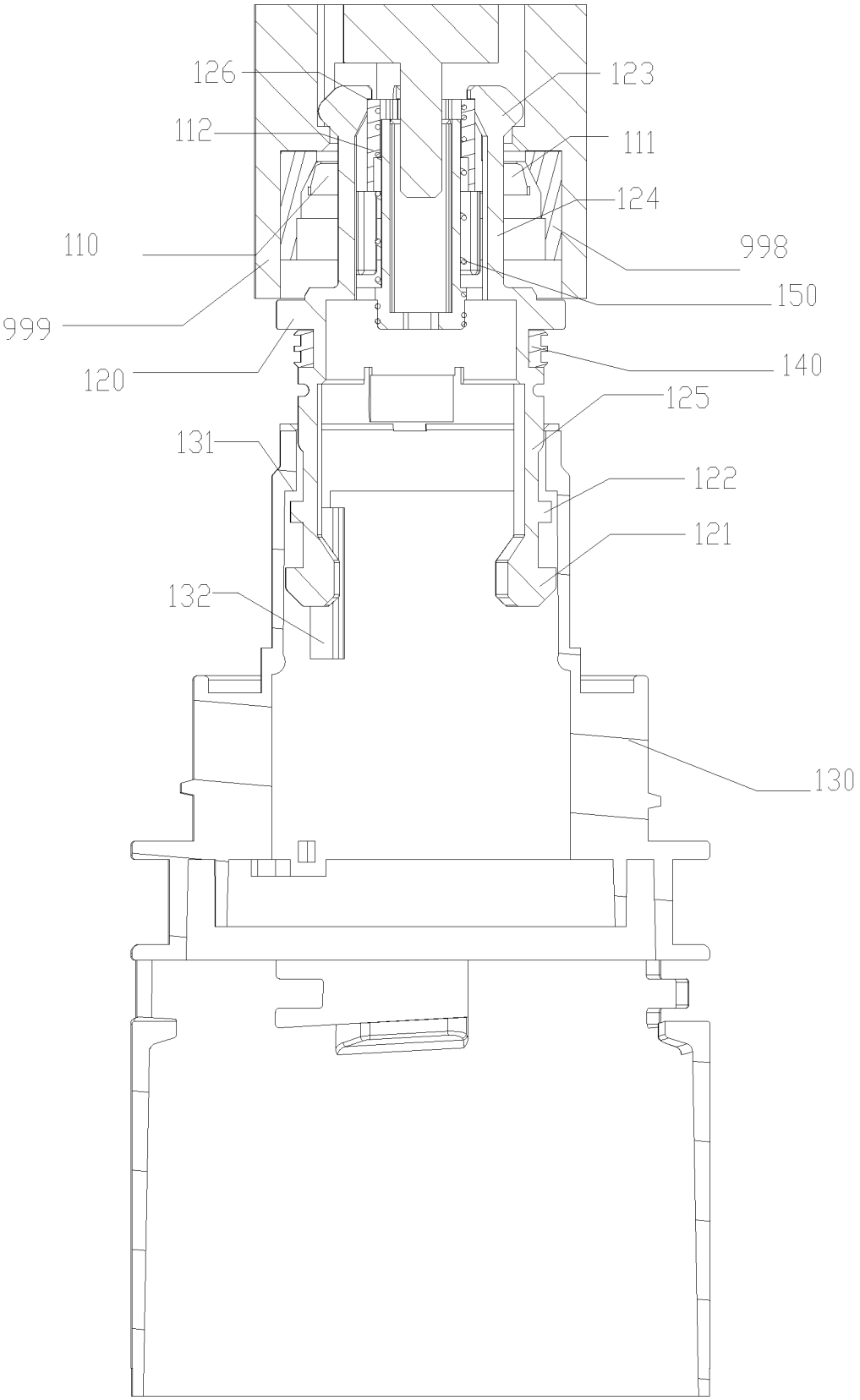

In the fifth step, the image forming device may drag the transmission element 130 or the toner cartridge body to move along the direction (the same direction as the direction of the toner cartridge body in the third step) away from the rotational driving force transmission part 999. Since the support rod 124 may not be inwardly deviated along the radial direction of the rotating axis of the toner cartridge body and the receiving element 120 may not be disengaged from the rotational driving force transmission part 999, a gap may be between the receiving element 120 and the transmission element 130 to allow the developer stored in the toner cartridge body to flow out, as shown in FIG. 8. Then, the image forming device may transmit the rotational driving force to the receiving element 120 through the rotational driving force transmission part 999, and then to the transmission element 130 through the transmission rod 125 and the protruding block 132, and finally to the toner cartridge body, thereby enabling the developer stored in the toner cartridge body to flow out continuously.

Figure 6:
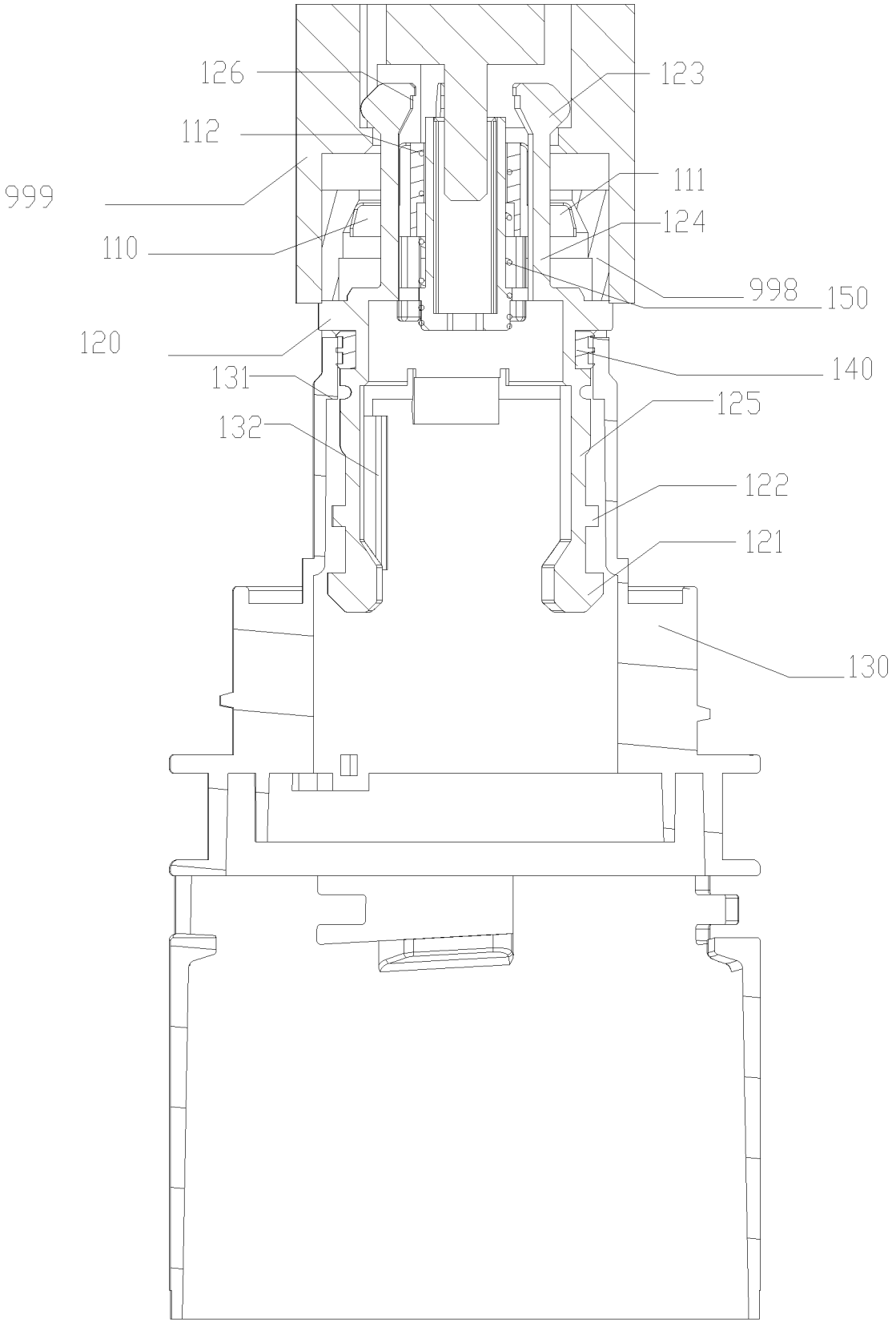

When the toner cartridge is uninstalled from the image forming device, in the state shown in FIG. 8, the image forming device may first push the transmission element 130 or the toner cartridge body to close the gap between the receiving element 120 and the transmission element 130 to be changed to the state shown in FIG. 7; then, the moving part 998 may move along the direction of the toner cartridge body and drive the moving element 110 to move along the direction of the toner cartridge body to be changed to the state shown in FIG. 6; next, the rotational driving force transmission part 999 may move along the direction away from the toner cartridge body to be changed to the state shown in FIG. 5; next, the moving part 998 may move along the direction away from the toner cartridge body, the moving element 110 may move along with the moving part 998 until the pushing element 112 interferes with the anti-detachment trench 126 to prevent the moving element 110 from moving further away from the toner cartridge; finally, the user may pull out the toner cartridge, and the force receiving part may be restored to the state shown in FIG. 4.

The Second Embodiment

The structure of the force receiving part in one embodiment may be substantially same as the structure of the force receiving part in the first embodiment. The difference is that the force receiving part in one embodiment may further include a second elastic element 160, and in order to accommodate the second elastic element 160, the shape of the receiving element 120 may be modified.

Figure 9:
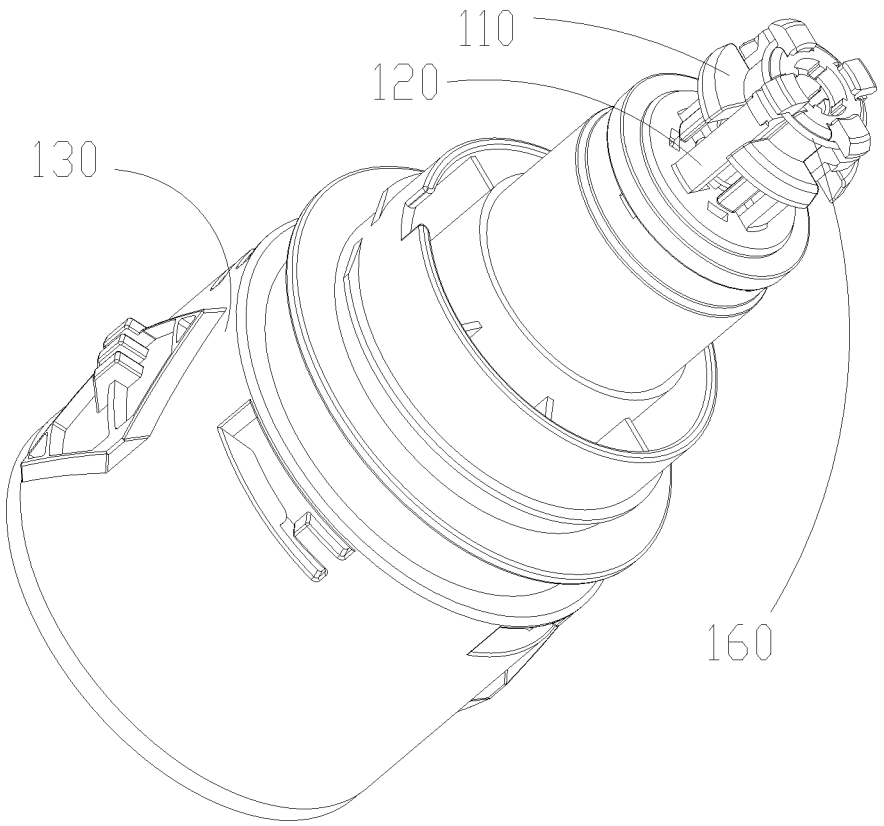
FIG. 9 illustrates a stereoscopic view of a force receiving part in the second embodiment.

As shown in FIG. 9, the elastic member 160 may be on the receiving element 120. Optionally, the second elastic member 160 may be on the receiving tooth 120, and obviously, the second elastic member 160 may also be disposed at other positions of the receiving element 120. A trench may be disposed on the receiving tooth 123, such that the second elastic element 160 may be accommodated in the trench. When the moving element 110 moves toward the toner cartridge body along the direction of the rotating axis of the toner cartridge, the support rod 124, under the action of the second elastic element 160, may be inwardly deviated along the radial direction of the rotating axis of the toner cartridge body. In one embodiment, the second elastic element 160 may be a ring-shaped elastic element and disposed coaxially with the rotating axis of the force receiving part. Optionally, the second elastic element 160 may be a rubber band.

Compared with the force receiving part involved in the first embodiment, for the force receiving part in one embodiment, the second elastic element 160 may inwardly restrict the receiving element 120 along the radial direction due to the elastic force, such that the interference between the receiving tooth 123 and the image forming device during the installation and uninstallation process may be reduced, and the installation and uninstallation process of the toner cartridge may be prevented from being not smooth due to the friction and collision between the receiving tooth 123 and the image forming device.

Optionally, in order to prevent the aged and fractured second elastic element 160 from falling into the image forming device when the second elastic element 160 is a rubber product, which may damage the electronic image forming quality or the image forming device, the second elastic element may be connected to the receiving tooth 123 or the support rod 124. Bonding, thermoforming, interference fit, and the like may be selected, which may not be described in detail herein.

The Third Embodiment

The structure of the force receiving part in one embodiment may be substantially same as the structure of the force receiving part in the first embodiment. The difference is that the structures of the moving elements 110*a* and the 110*b* in one embodiment may be different from the structure of the moving element 110 in the first embodiment.

The process of installing the toner cartridge into the image forming device is described in detail hereinafter. The moving part 997 on the image forming device may be located outside the rotational driving force transmission part 999.

Figure 10:
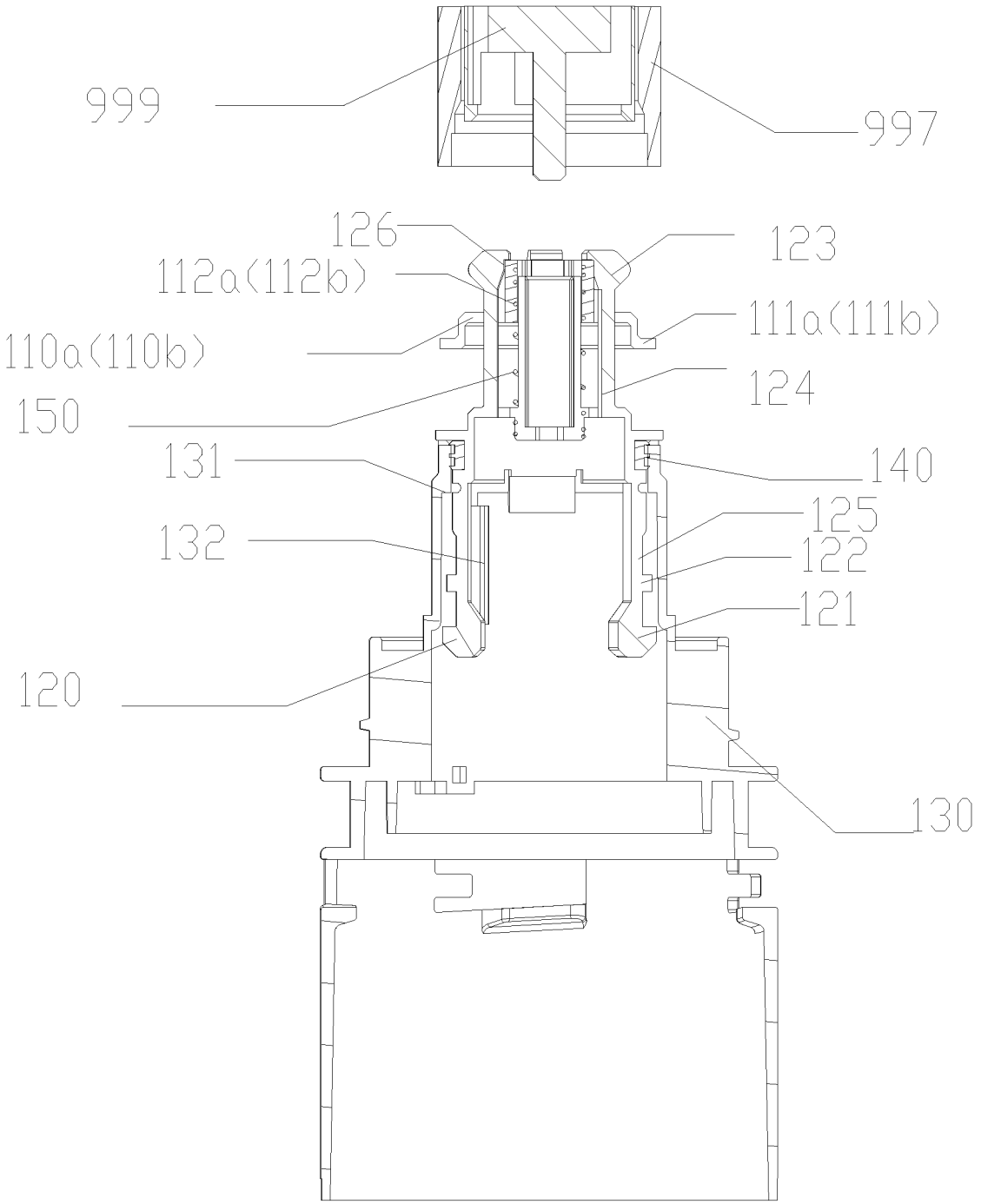
FIGS. 10-14 illustrate cross-sectional views of a force receiving part in different states along a cross-sectional plane of the toner cartridge body in the third embodiment.

In the first step, as shown in FIG. 10, when the toner cartridge is not installed in the image forming device, the pushing element 112*a* (112*b*) of the force receiving part may be in the anti-detachment trench 126; at this point, the support rod 124 may not be inwardly deviated along the radial direction of the rotating axis of the toner cartridge body. The receiving element 120 and the transmission element 130 may be attached firmly to prevent the developer stored in the toner cartridge body from flowing out. Optionally, the elastic washer 140 may be further disposed between the receiving element 120 and the transmission element 130 to improve the sealing performance.

Figure 11:
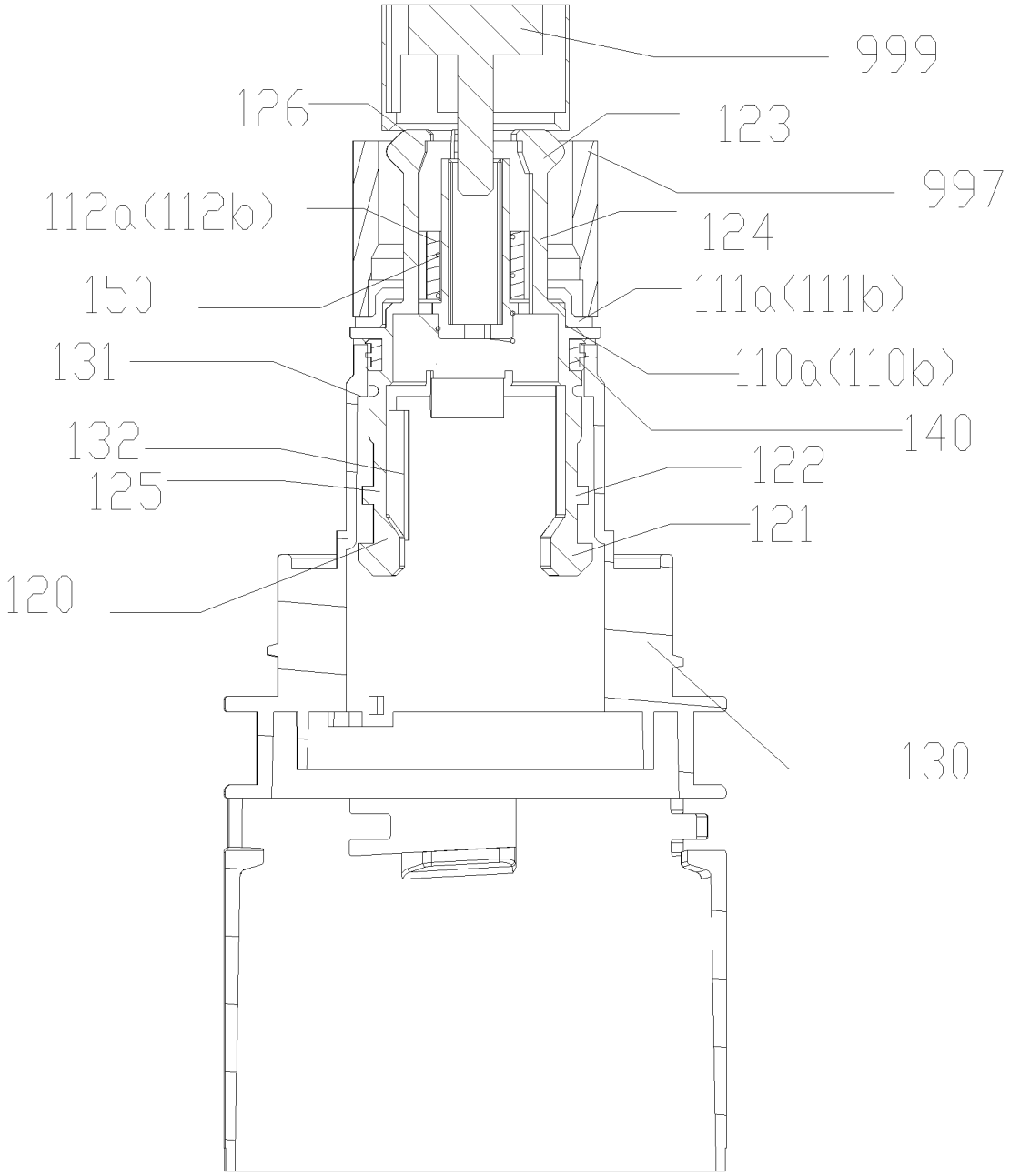

In the second step, after the toner cartridge is installed in the image forming device, since the radial distance between the abutting portion 111*a* (111*b*) and the rotating axis of the toner cartridge body is greater than the radial distance between the receiving tooth 123 and the rotating axis of the toner cartridge body, the moving part 997 of the image forming device may push the abutting portion 111*a* (111*b*) to move the moving element 110*a* (110*b*) along the direction of the toner cartridge body and the pushing element 112*a* (112*b*) may be detached from the anti-attachment trench 126, as shown in FIG. 11. At this point, the support rod 124 may be inwardly deviated along the radial direction of the rotating axis of the toner cartridge body.

Figure 12:
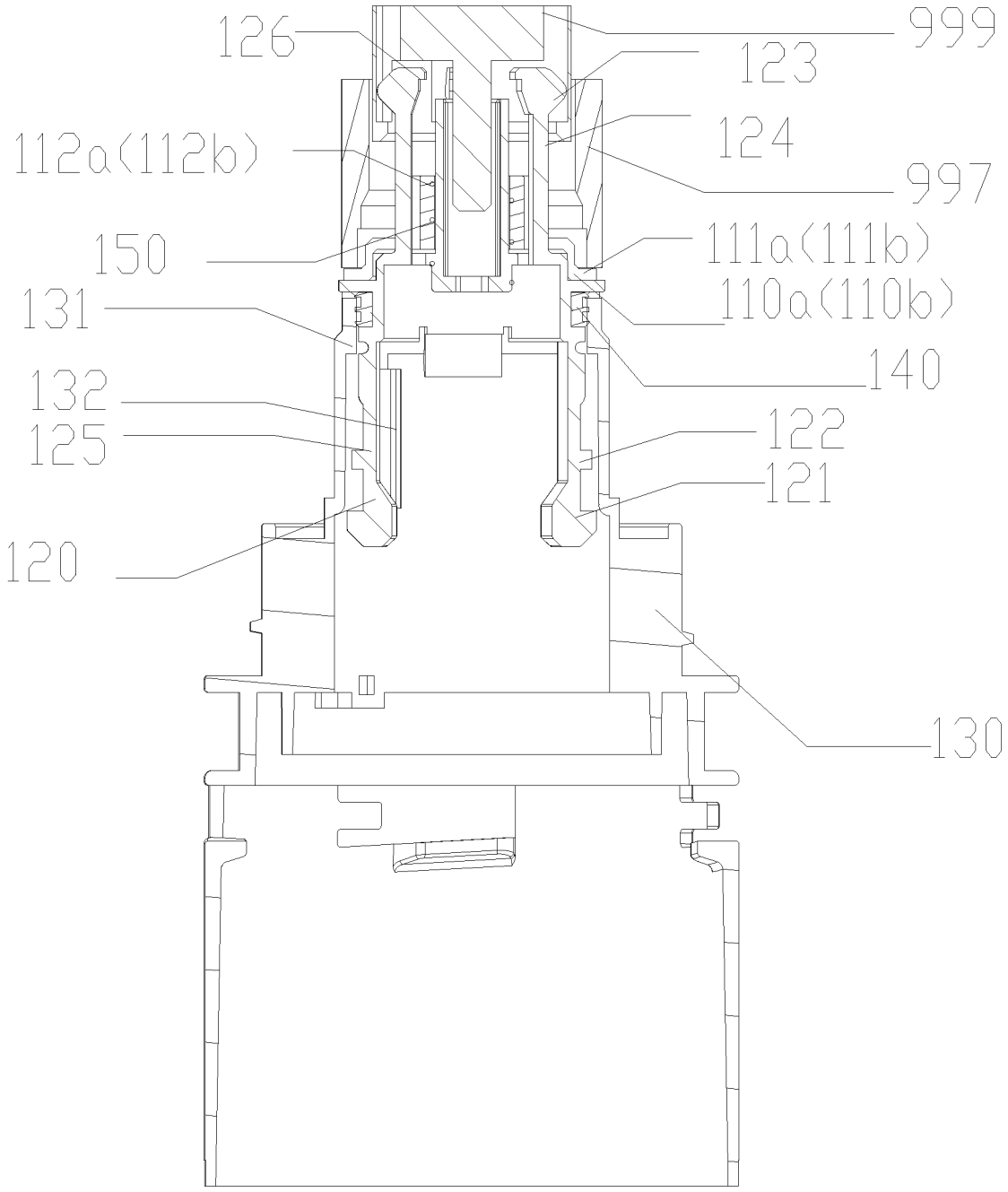

In the third step, the rotational driving force transmission part 999 on the image forming device may move along the direction of the toner cartridge body. Due to the interference between the rotational driving force transmission part 999 and the driving tooth 123, the support rod may be inwardly deviated along the radial direction of the rotating axis of the toner cartridge body, and the receiving element 120 may be engaged with the rotational driving force transmission part 999, as shown in FIG. 12.

Figure 13:
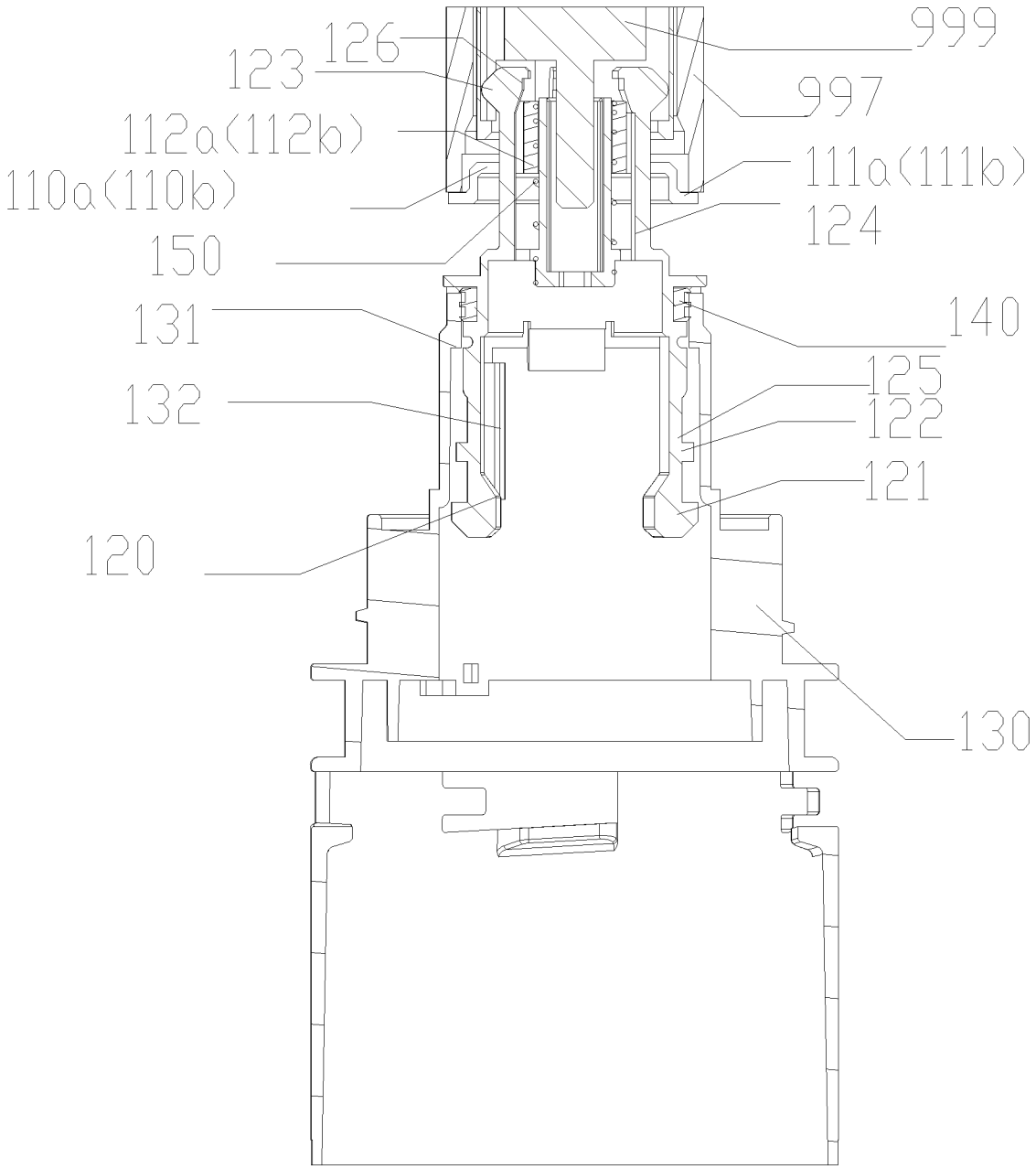

In the fourth step, the moving part 997 on the image forming device may move along the direction away from the toner cartridge body. Due to the existence of the first elastic element 150, the moving element 110*a* (110*b*) may follow the moving part 997 to move along the direction away from the toner cartridge body. However, unlike the first embodiment, the moving part 997 may limit the distance that the moving element 110*a* (110*b*) can move away from the toner cartridge, so that the abutting portion 112*a* (112*b*) may not completely enter the anti-detachment trench 126, as shown in FIG. 13. At this point, since the support rod 124 is pressed and abutted against by the abutting portion 112, the support rod 124 may not be inwardly deviated along the radial direction of the rotating axis of the toner cartridge body. However, if an appropriate force is applied, the end of the support rod 124 adjacent to the anti-detachment trench 126 and the receiving tooth 123 may still be slightly and inwardly deviated along the radial direction of the rotating axis of the toner cartridge body.

Figure 14:
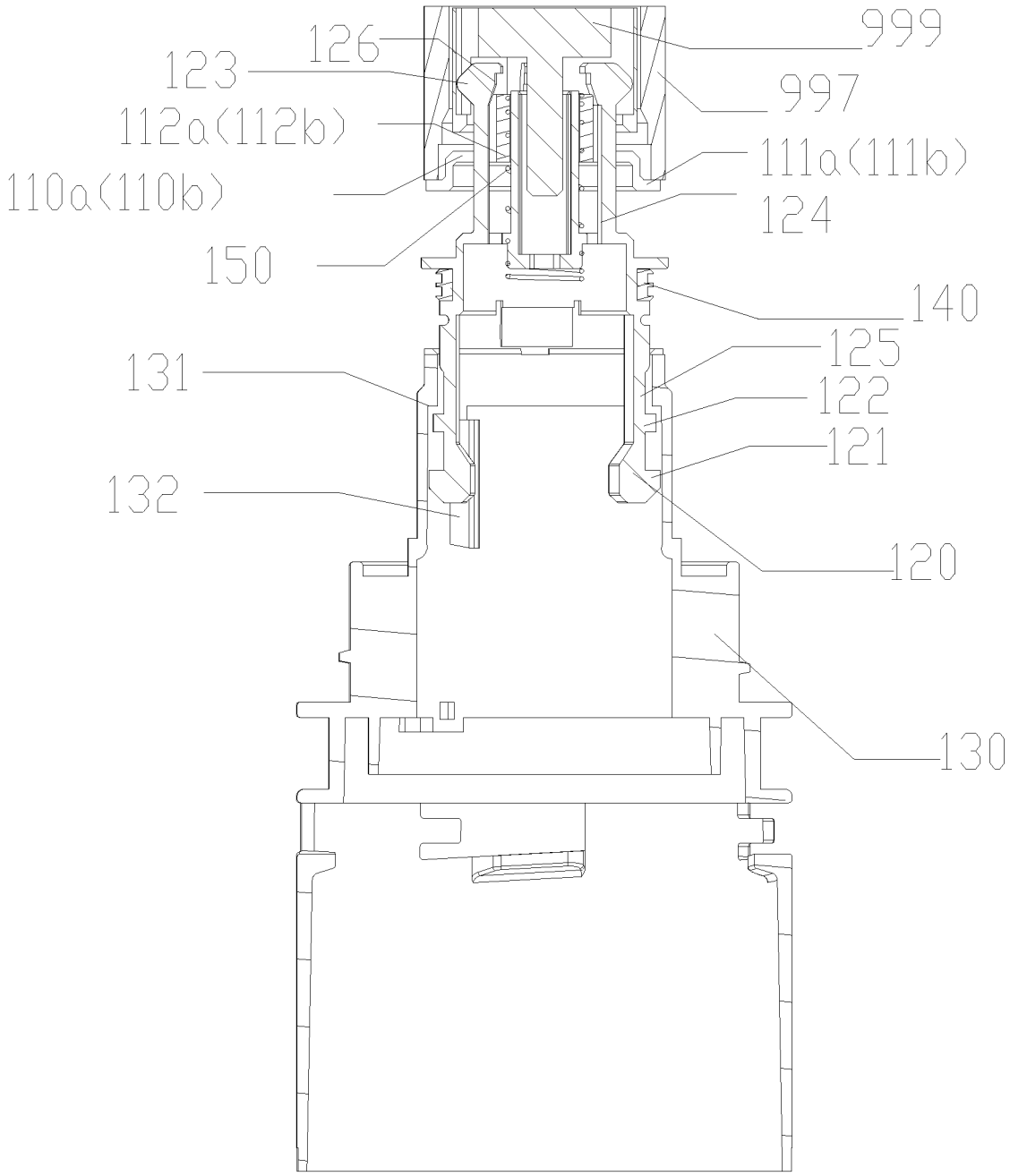

In the fifth step, the image forming device may drag the transmission element 130 or the toner cartridge body to move along the direction (the same direction as the direction of the toner cartridge body in the third step) away from the rotational driving force transmission part 999. The inward radial deviation of the support rod 124 along the radial direction of the rotating axis of the toner cartridge body is limited and the force required for the disengagement between the receiving element 120 and the rotational driving force transmission part 999 may be greatly greater than the friction between the receiving element 120 and the transmission element 130. Therefore, a gap may be formed between the receiving element 120 and the transmission element 130 to allow the developer stored in the toner cartridge body to flow out, as shown in FIG. 14. Then, the image forming device may transmit the rotational driving force to the receiving element 120 through the rotational driving force transmission part 999, and then to the transmission element 130 through the transmission rod 125 and the protruding block 132, and finally to the toner cartridge body, thereby enabling the developer stored in the toner cartridge body to flow out continuously.

The uninstallation process of the force receiving part from the image forming device may be substantially same as the uninstallation process in the first embodiment, which may not be described in detail herein. The advantage of such design in one embodiment may be that, due to the problems such as precision and the like, the rotational driving force transmission part in certain machine models may still move a short distance along the direction of the toner cartridge during the process of uninstalling the toner cartridge from the image forming device. In such way, uninstalling the toner cartridge using the design in one embodiment may be easier than uninstalling the toner cartridge using the design in the first embodiment.

Figure 15:
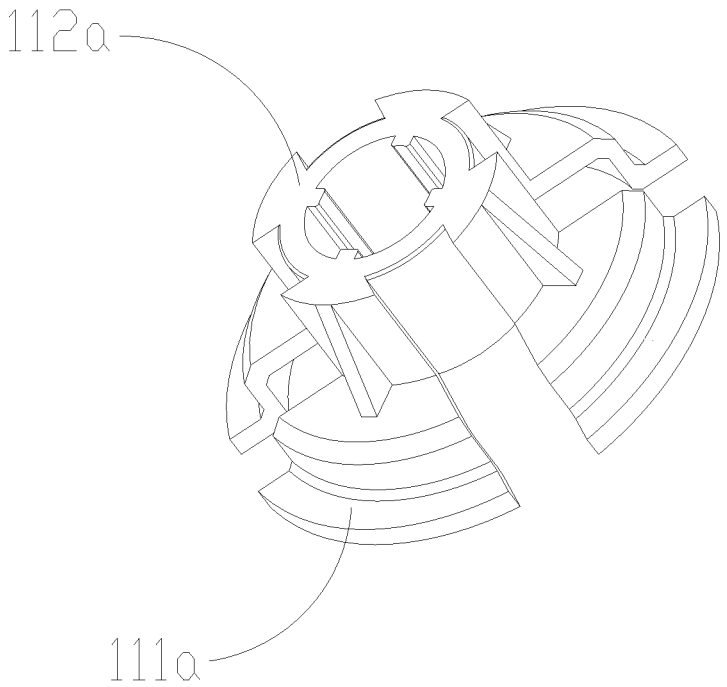
FIG. 15 illustrates a stereoscopic view of a first moving element in the third embodiment.
Figure 16:
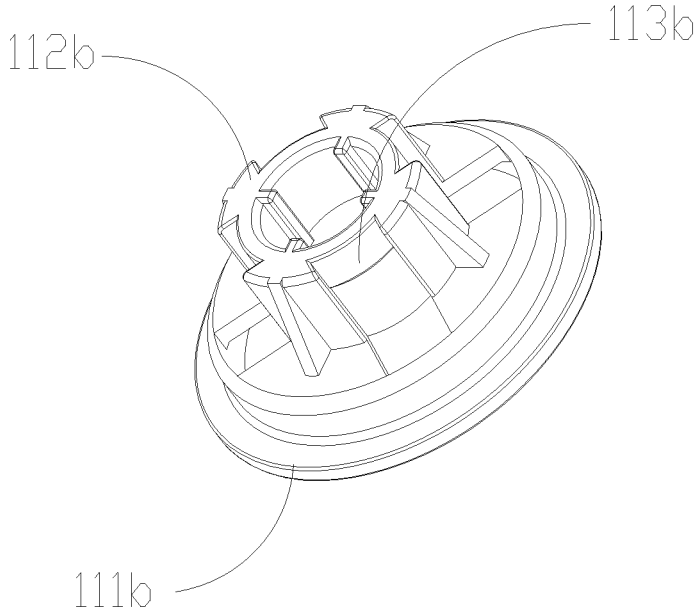
FIG. 16 illustrates a stereoscopic view of a second moving element in the third embodiment.

The moving element 110*a* is shown in FIG. 15 and the moving element 110*b* is shown in FIG. 16. Both of two moving elements may be used in the design in one embodiment. The difference is that the abutting portion 111*b* for the moving element 110*b* is less likely to be deformed and damaged than the abutting portion 111*a* of the moving element 110*a*, and a stiffener 113*b* may be disposed adjacent to the pushing element 112*b*. The use of such two moving elements may mainly depend on factors, such as the size of the force receiving part, the amount of the developer contained in the toner cartridge, the cost constraints of different quality products, and the like.

The Fourth Embodiment

A moving part, including the first moving element 110*c*1 and the second moving element 110*c*2 which are independent of each other, may be mainly provided in one embodiment, and other parts may be the same as the force receiving part in the third embodiment.

Figure 17:
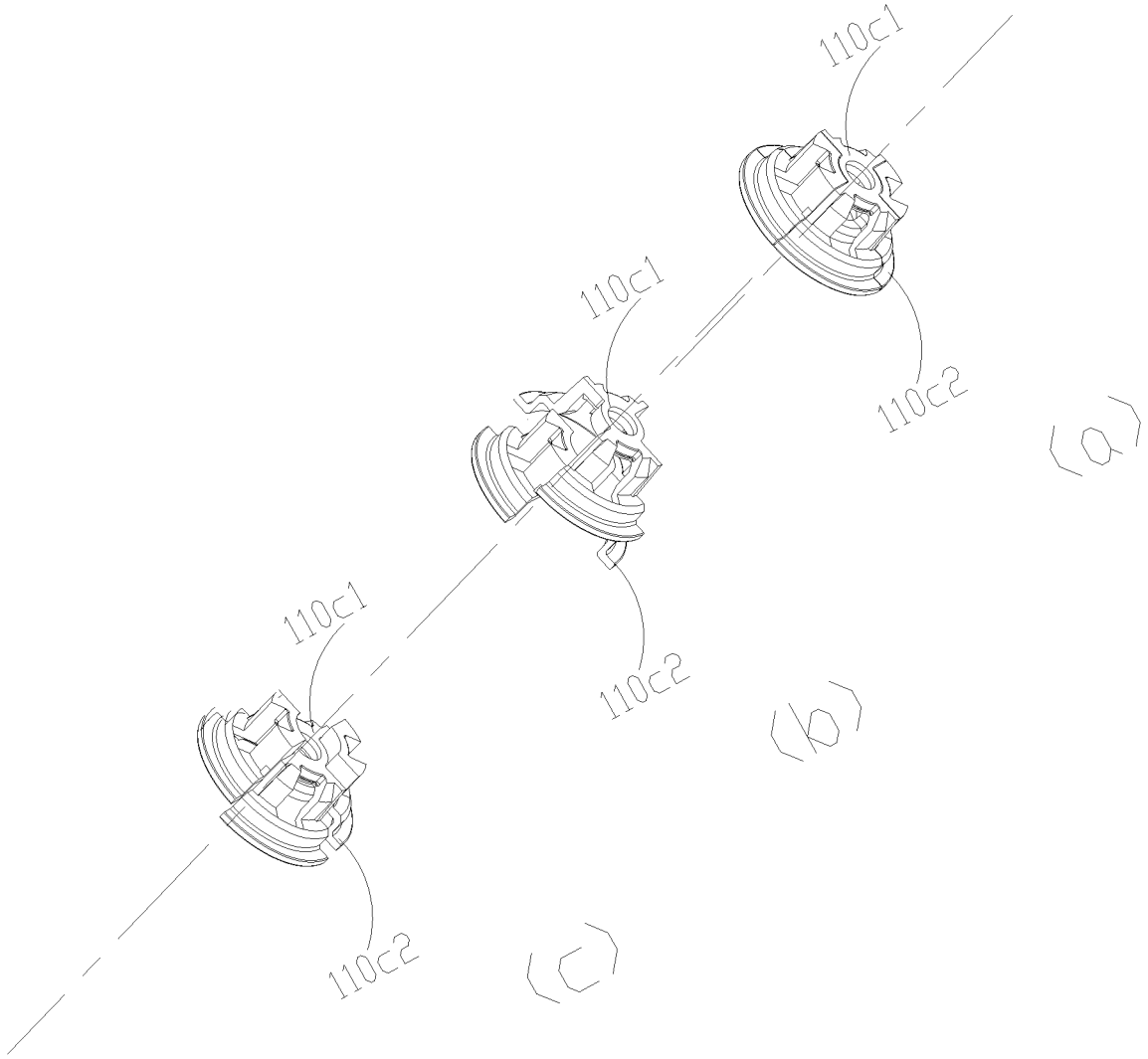
FIG. 17 illustrates stereoscopic views of a first moving element and a second moving element in different states in the fourth embodiment.
Figure 18:
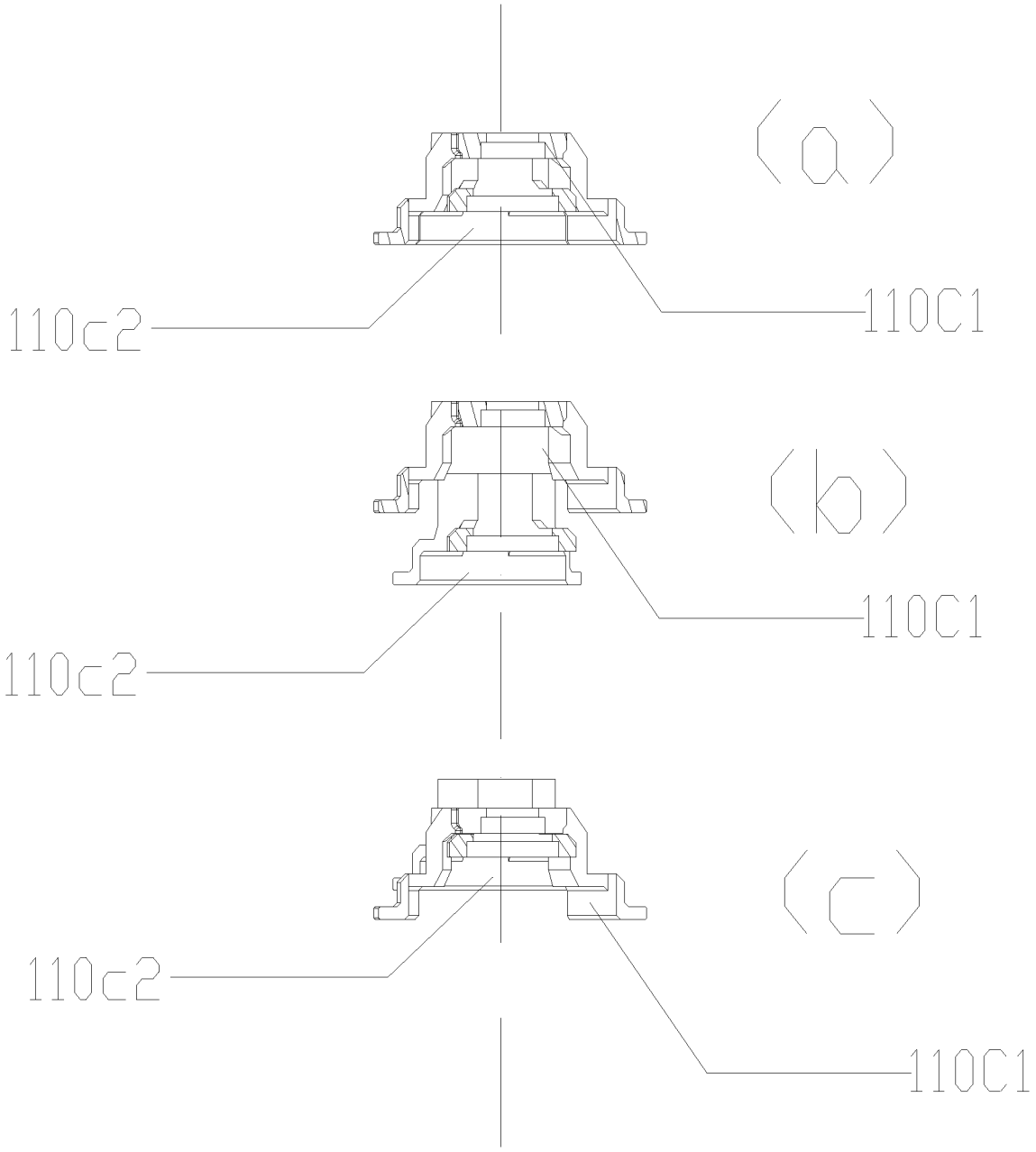
FIG. 18 illustrates cross-sectional views of a first moving element and a second moving element in different states along a cross-sectional plane of a rotating axis of the toner cartridge body in the fourth embodiment.

The first moving element 110*c*1 and the second moving element 110*c*2 involved in one embodiment are shown in FIG. 17 and FIG. 18. The first moving element 110*c*1 and the second moving element 110*c*2 may be independent of each other and may both perform the function of the moving element 110. When the first moving element 110*c*1 and the second moving element 110*c*2 are assembled and installed on the force receiving part, one elastic element may be disposed between each of the two moving elements, including the first moving element 110*c*1 and the second moving element 110*c*2, and the receiving element 120. Due to the function of the elastic element and the restriction of the anti-detachment trench 126 on the receiving element 120, the assembly of the first moving element 110*c*1 and the second moving element 110*c*2 may be on a same plane at this point, and the assembly structure may be similar to the structure of the moving element 110*b* (FIG. 16) in the third embodiment. When the image forming device operates normally, the structures of the first moving element 110*c*1 and the second moving element 110*c*2 may be substantially same as the structures of the force receiving parts in the third embodiment, as shown in FIG. 17*a* and FIG. 18*a* at this point.

However, when the internal parts of the image forming device are broken or deformed due to long work period, or when the internal parts of the image forming device interfere with the moving elements due to the precision problem during the production process of the image forming device, if the moving elements is an integrated structure, it may cause the movement of the moving elements to be restricted, so that the moving elements may not function normally and the toner cartridge may not be installed normally, which may affect the electronic image formation. However, in one embodiment, if the movement of the second moving element 110*c*2 is restricted, the first moving element 110*c*1 may still normally complete the function of the moving element to enable the toner cartridge to work normally, as shown in FIGS. 17*b* and 18*b*; similarly, if the movement of the first moving element 110*c*1 is restricted, the second moving element 110*c*2 may still normally complete the function of the moving element to enable the toner cartridge to work normally, as shown in FIGS. 17*c* and 18*c*.

Figure 19:
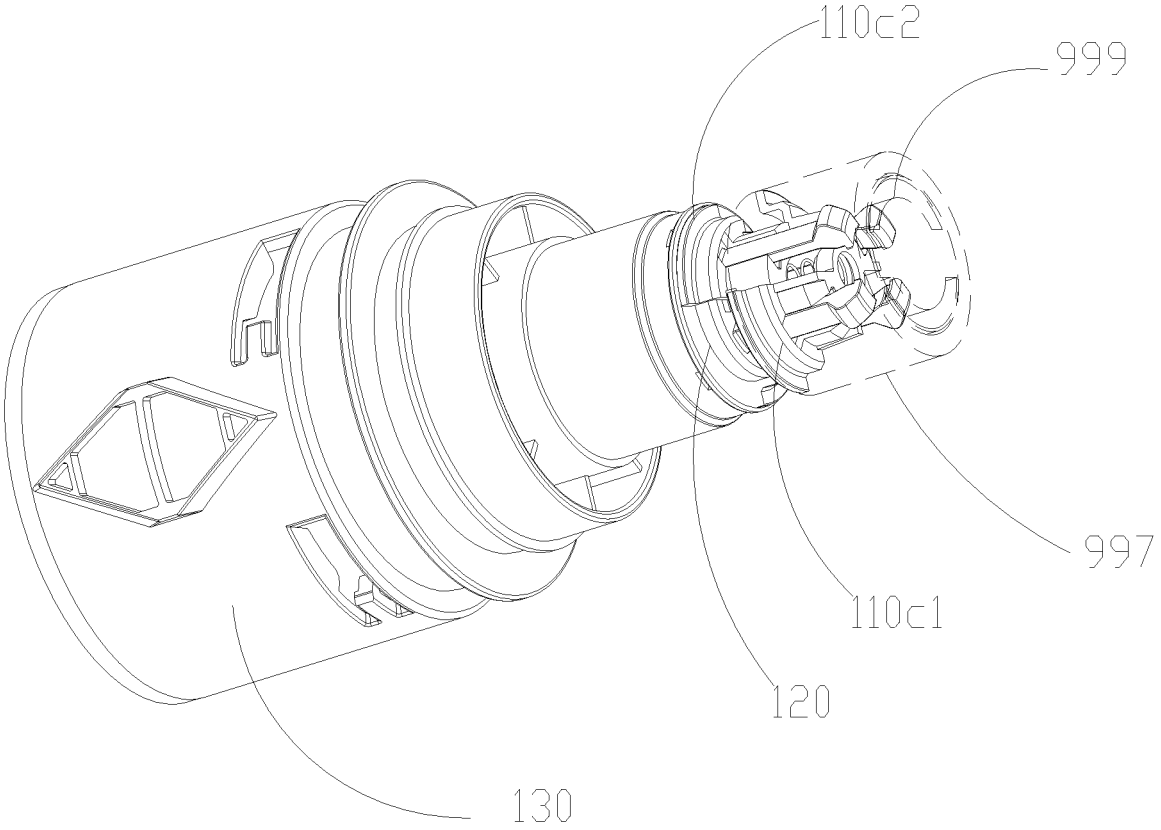
FIGS. 19-20 illustrate structural stereoscopic views of a first moving element and a second moving element when the second moving element is restricted in the fourth embodiment.
Figure 20:
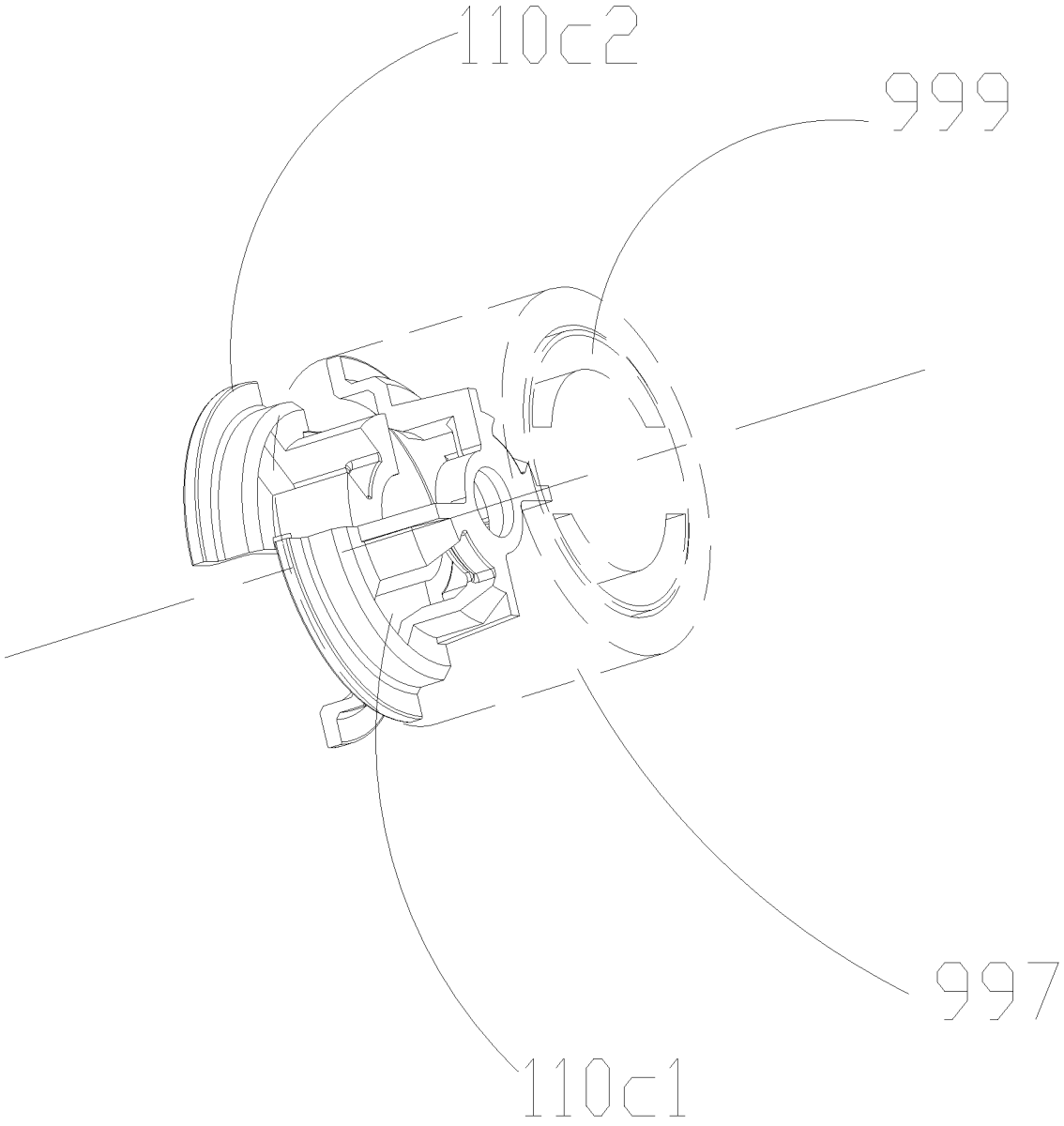

For example, in the fourth step of the third embodiment, when the toner cartridge is installed on the image forming device, during the process of the moving part 997 on the image forming device moving away from the direction of the toner cartridge body, if the movement of the second moving element 110*c*2 is restricted, the first moving element 110*c*1 may still move normally away from the direction of the toner cartridge body and restrict the moveable portion 120. Therefore, the moving element 120 may not be disengaged from the rotational driving force transmission part 999 on the image forming device, as shown in FIG. 19 and FIG. 20, and the fifth step may be continued, thereby enabling the developer to flow out normally. The states shown in FIG. 19 and FIG. 20 may be the same as the states shown in FIG. 17*b* and FIG. 18*b* and may be similar to the states shown in FIG. 17*c* and FIG. 18*c*, which may not be limited in detail herein.

It should be noted that, in one embodiment, when the first moving element 110*c*1 is pushed toward the direction of the toner cartridge body to the maximum distance and the first moving element 110*c*1 is fixed, the distance that the second moving element 110*c*2 may move relative to the first moving element 110*c*1 away from the direction of the toner cartridge may be greater than or equal to the displacement of the second moving element 110*c*2 being pushed by the moving part 997 on the image forming device, which may ensure that in the states of FIG. 17*c* and FIG. 18*c*, the second moving element 110*c*2 may move a sufficient distance away from the direction of the toner cartridge body when the movement of the first moving element 110*c*1 is restricted, thereby preventing the support rod 124 on the transmission element 120 from being deviated inwardly relative to the radial direction of the rotating axis of the toner cartridge body.

The Fifth Embodiment

A force receiving part used for the toner cartridge is provided in one embodiment, which may enable the toner cartridge to receive the rotational driving force provided by the image forming device. FIGS. 21-30 are schematics of the force receiving part according to one embodiment.

Figure 21:
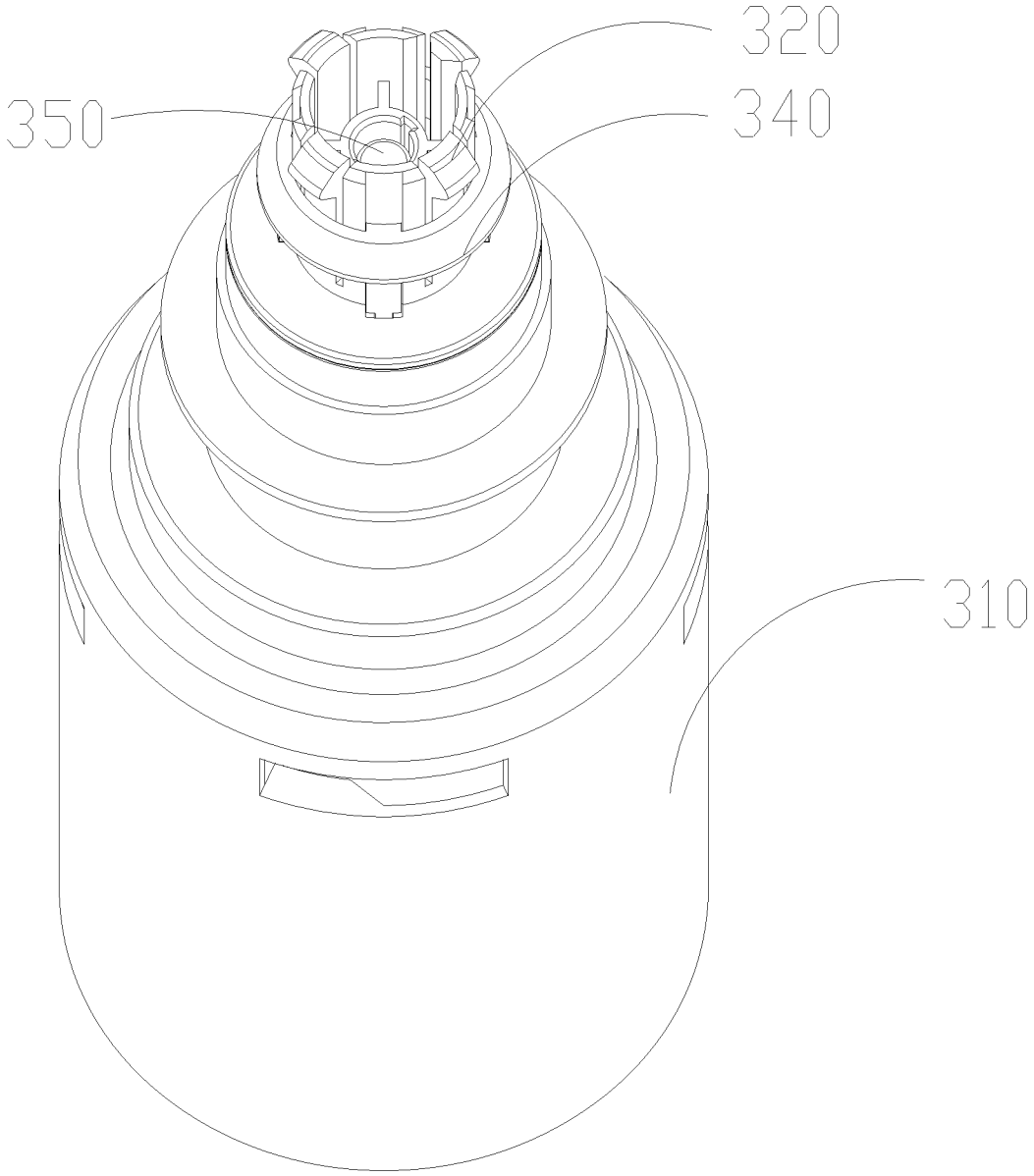
FIG. 21 illustrates a stereoscopic view of a force receiving part in the fifth embodiment.
Figure 22:
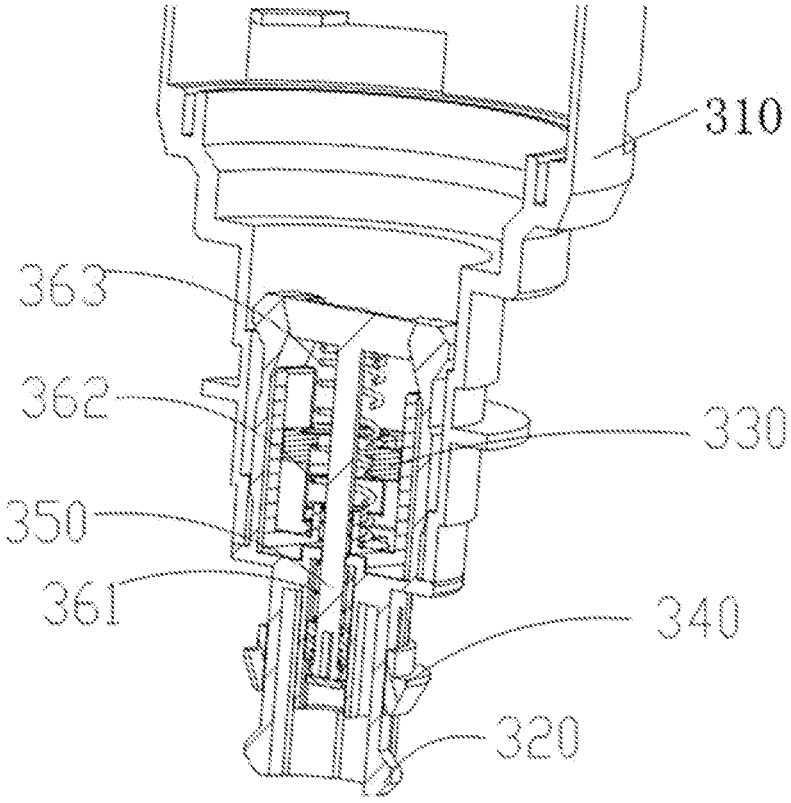
FIG. 22 illustrates a cross-sectional view of a force receiving part after being cut along the length direction of the force receiving part in the fifth embodiment.

FIG. 21 illustrates a stereoscopic view of a force receiving part. FIG. 22 illustrates a cross-sectional view of a force receiving part after being cut along the length direction of the force receiving part. The force receiving part may include a connecting portion 310, a driving head 320, a stopper 330, a moving element 340, a rod 350, and three elastic elements including a first elastic element 361, a second elastic element 362, and a third elastic element 363.

Figure 23:
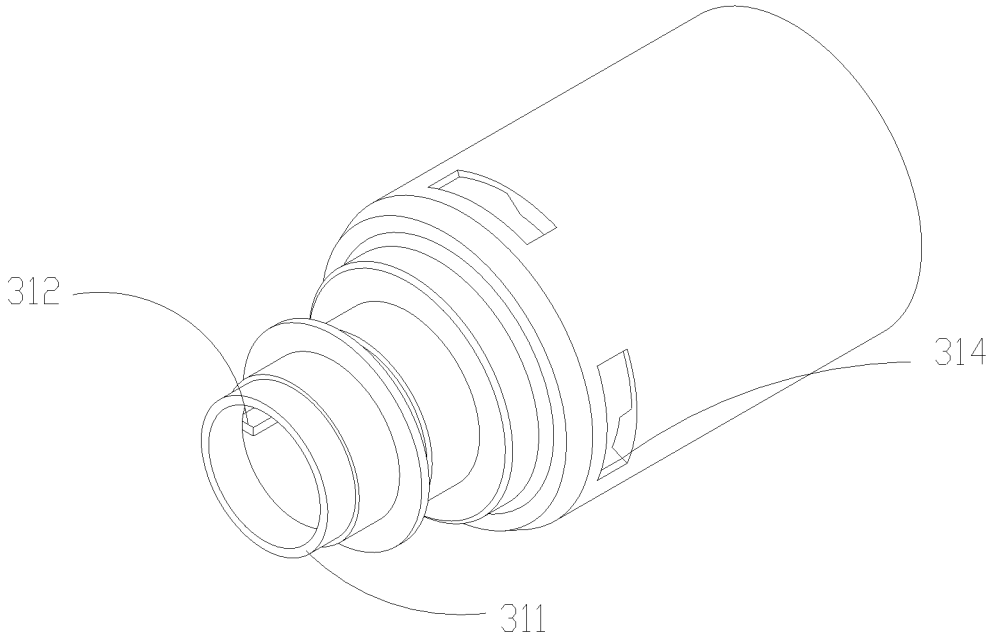
FIG. 23 illustrates a stereoscopic view of a connecting portion in the fifth embodiment.
Figure 24:
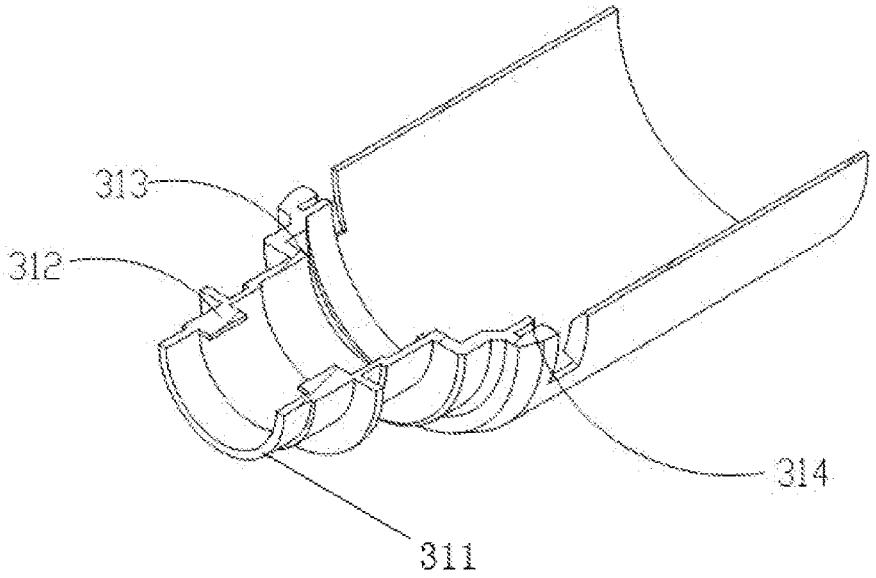
FIG. 24 illustrates a cross-sectional view of a connecting portion after being cut along the length direction of the force receiving part in the fifth embodiment.
Figure 25:
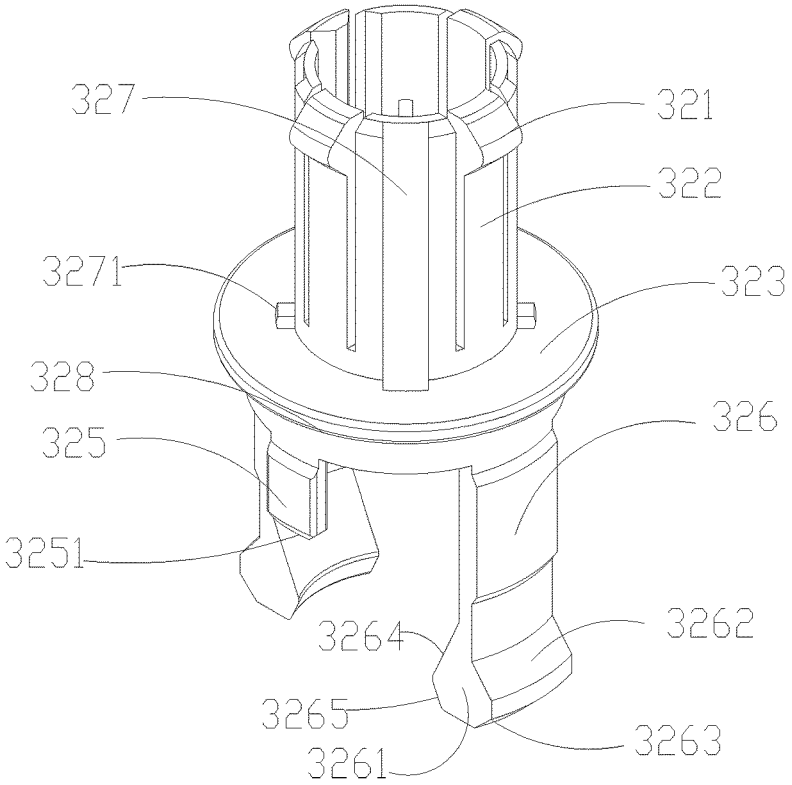
FIG. 25 illustrates a stereoscopic view of a driving head in the fifth embodiment.
Figure 26:
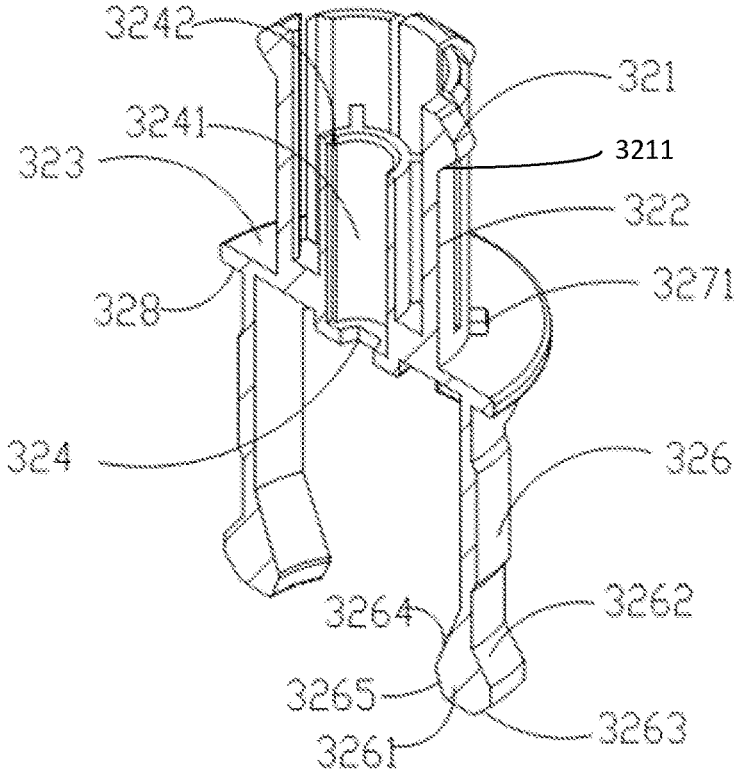
FIG. 26 illustrates a cross-sectional view of a driving head after being cut along the length direction of the force receiving part in the fifth embodiment.

FIG. 23 illustrates a stereoscopic view of the connecting portion 310. FIG. 24 illustrates a cross-sectional view of the connecting portion 310 after being cut along the length direction of the force receiving part. The connecting portion 310 may include a first abutting surface 311, a fixing protruding block 312, a protruding eave 313, and a buckle 314, where the buckle 314 is used for connecting with the toner cartridge body. FIG. 25 illustrates a stereoscopic view of the driving head 320. FIG. 26 illustrates a cross-sectional view of the driving head 320 after being cut along the length direction of the force receiving part. The driving head 320 may include a driving tooth 321, a fixing rod 322, a second abutting surface 323, a first limiting hole 324, a limiting protrusion 325, a transmission rod 326, a guide trench 327, and an eighth abutting surface 328, where the driving tooth 321 may protrude along the direction perpendicular to the length direction of the force receiving part, and may be connected to the fixing rod 322. The driving tooth 321 may have a side surface adjacent to the direction of the toner cartridge body, and the side surface may be a driving tooth lower inclined surface 3211. The driving tooth inclined surface 3211 may be inclined toward the direction of the toner cartridge body along the length direction of the toner cartridge body. The free end of the fixing rod 322 protruding from the second abutting surface 323 may be connected to the driving tooth 321. Optionally, a hollow protrusion 3241 may be disposed around the first limiting hole 324 along the length direction of the force receiving part, and the limiting trench 3242 may also be disposed on the inner wall of the hollow protrusion 3241. A third abutting surface 3251 may be disposed on the free end of the limiting protrusion 325. The transmission rod 326 may protrude from the eighth abutting surface 328 toward the direction of the toner cartridge body along the length direction of the force receiving part, and a protrusion 3261 may be disposed on the free end of the transmission rod 326. Optionally, a fourth abutting surface 3262, a fifth abutting surface 3263, a sixth abutting surface 3264, and a seventh abutting surface 3265 may be disposed on the protrusion 3261. The guide trench 327 may pass through the second abutting surface 323 and the eighth abutting surface 328, and a guide hole 3271 may be formed. Optionally, the quantity of the transmission rods 326 may be two, the quantities of the fixing rods 322 and the driving teeth 321 may respectively be four, and the quantities of the guide trenches 327 and the guide holes 3271 may respectively be four. The protrusion 3261 may be snapped onto the protruding eave 313 of the connecting portion 310. The transmission rod 326 may be elastically deformable, so that the protrusion 3261 may move to a certain extent, thereby firmly connecting the driving head 320 with the connecting portion 310. The driving tooth lower inclined surface 3211 may be disposed on the driving tooth 321, such that the driving head 320 may not be snapped to affect the uninstallation process of the toner cartridge when the driving head 320 is detached from the image forming device.

Figure 27:
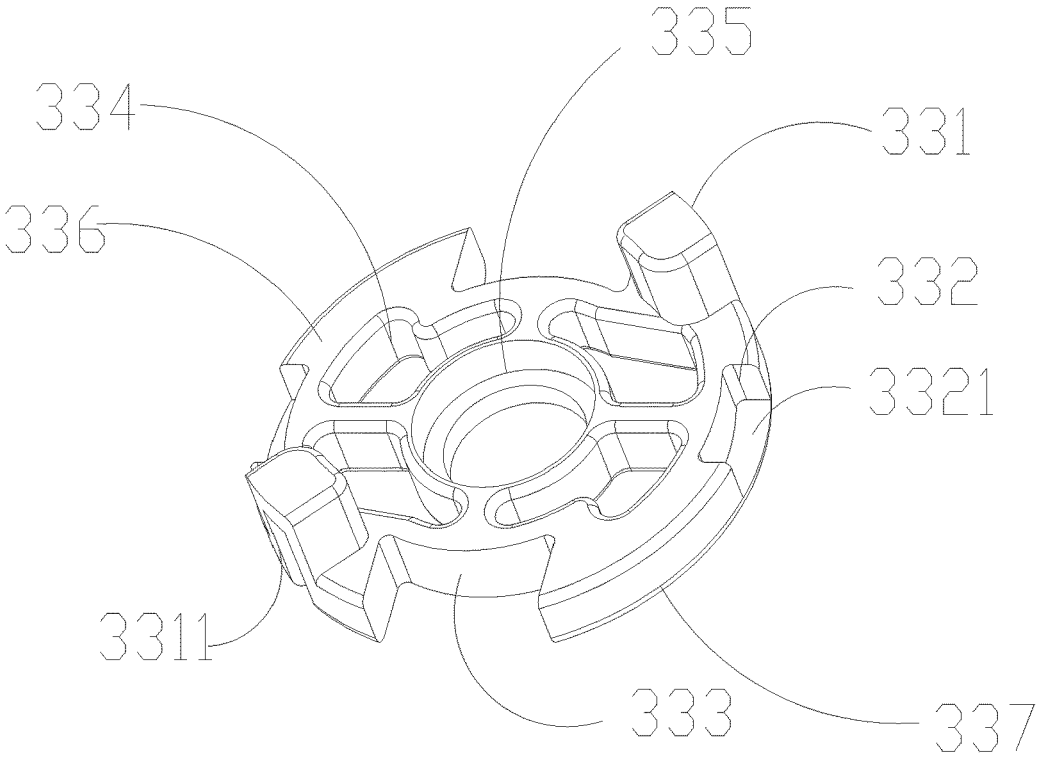
FIG. 27 illustrates a stereoscopic view of a stopper in the fifth embodiment.

FIG. 27 illustrates a stereoscopic view of the stopper 330. The stopper 330 may include a fixing portion 331, a blocking portion 332, a transmission hole 333, a through hole 334, a second limiting hole 335, a tenth abutting surface 336, and the eleventh abutting surface 337, where a fixing trench 3311 may be optionally disposed on the fixing portion 331, the fixing trench 3311 may be connected to the fixing protrusion 312 of the connecting portion 310, and a ninth abutting surface 3321, which may be abutted against the third abutting surface 3251 on the limiting protrusion 325 of the driving head, may be further disposed on the blocking portion 332. Furthermore, the blocking portion 332 may not only be disposed between the tenth abutting surface 336 and the eleventh abutting surface 337, and also be disposed on the fixing portion 331 by changing the position of the fixing protrusion 312 on the connecting portion 310, or the distance that the limiting protrusion 325 protrudes from the driving head 320, or the height of the fixing portion 331 on the stopper 330. The separate arrangement of the stopper 330 and the connecting portion 310 may not only reduce the difficulty of the entire production process, but also reduce the difficulty of reprocessing defective products; the arrangement of the through hole 334 and the transmission hole 333 may enable the developer in the toner cartridge body to flow out smoothly without causing blockage.

Figure 28:
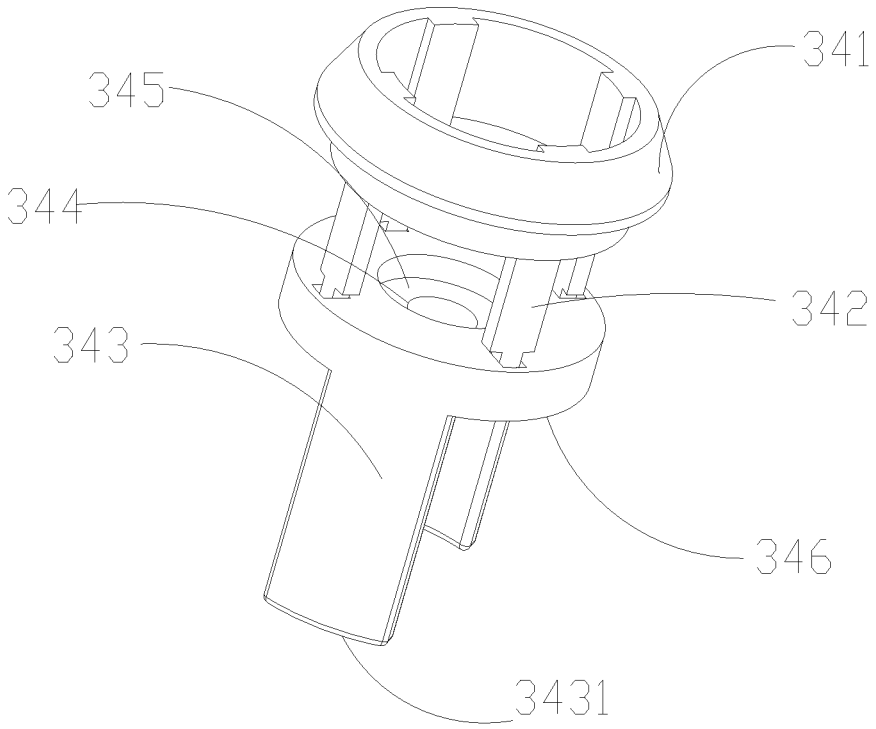
FIG. 28 illustrates a stereoscopic view of a moving element in the fifth embodiment.

FIG. 28 illustrates a stereoscopic view of the moving element 340. The moving element 340 may include a twelfth abutting surface 341, a connecting rod 342, a pushing rod 343, a third limiting hole 344, a thirteenth abutting surface 345, and the fourteenth abutting surface 346, where optionally, the quantity of the pushing rods 343 may be two, and the pushing rods 343 may protrude from a direction perpendicular to the fourteenth abutting surface 346. A free end 3431 may be on the pushing rod 343, and the twelfth abutting surface 341 may be abutted against the pushing device in the image forming device. Optionally, the structures including the twelfth abutting surface 341 may be connected by the connecting rod 342. The driving head 320 may be pushed by the moving part 340, especially acting on the deformable transmission rod 326 directly, such that the driving head 320 may not be stuck in the process of moving toward the toner cartridge, and the breakage risk of the transmission rod 326 after long time use may also be reduced. The arrangement of the sixth abutting surface 3264 on the driving head 320 may also reduce the adverse effect of the contact of the transmission rod 326 with the free end 3431 of the pushing rod on the lifetime of the transmission rod 326.

Figure 29:
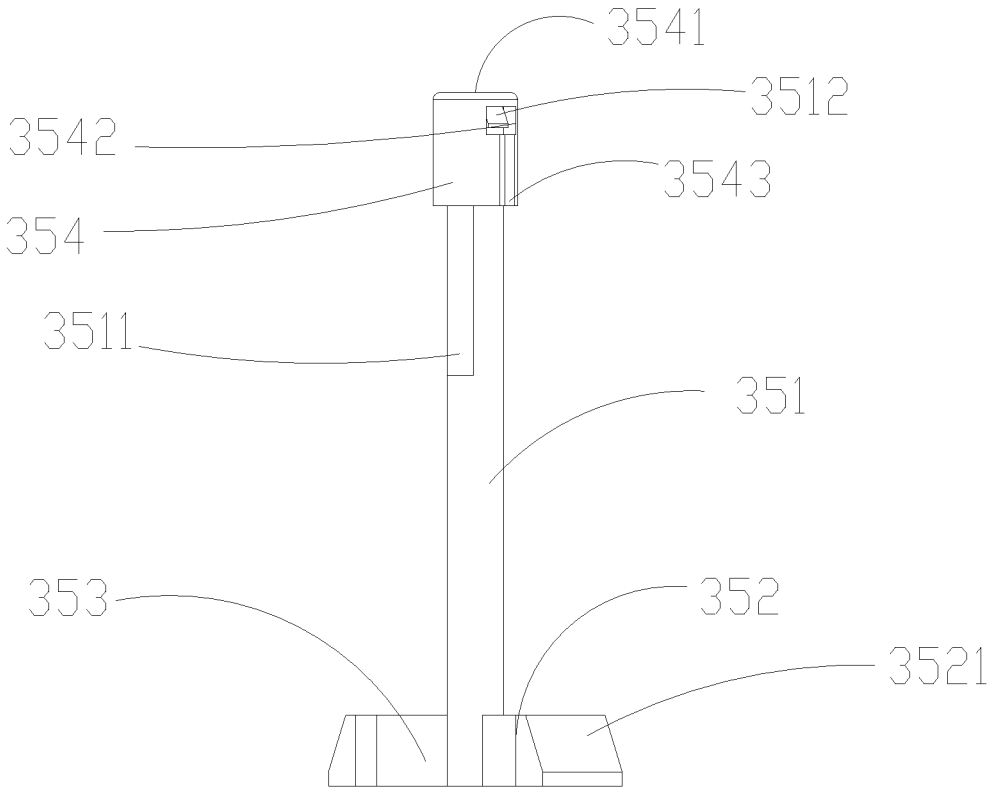
FIGS. 29-30 illustrate stereoscopic views of a rod from different angles in the fifth embodiment.
Figure 30:
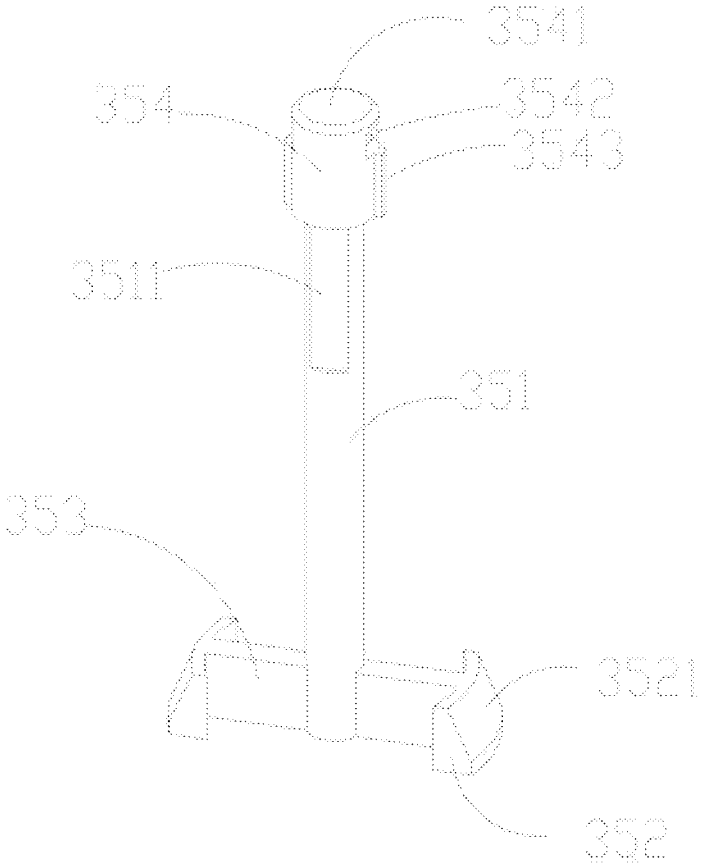

FIGS. 29-30 illustrate stereoscopic views of the rod 350 from different angles. The rod 350 may include a rod body 351, a pushing block 352, a connecting rod 353, and a rod cap 354, wherein a trench 3511 may be optionally disposed on the rod body 351, the rod cap 354 may be disposed on one end of the rod body 351 and the connecting rod 353 may be connected to the other end of the rod body 351. A fifteenth abutting surface 3521 may be disposed on the pushing block 352, a sixteenth abutting surface may be disposed on the rod cap 354, and the sixteenth abutting surface may be abutted against the needle device of the image forming device. An anti-lost protrusion 3543 may be optionally disposed on the rod cap 354 to restrict the moving range of the rod 350. The connecting rod 353 may be connected to the rod body 351 and the pushing block 352, and the rod cap 354 may be connected to the rod body 351. Optionally, a triangular protrusion 3512 may be disposed on the rod body 351, and a window 3542 may be disposed at the rod cap 354 accordingly, such that the triangular protrusion 3512 may protrude from the window 3542, thereby installing the rod cap 354 on the rod body 351. The trench 3511 on the rod body 351 may contain the first elastic element 361. Optionally, the anti-lost protrusion 3543 of the rod cap 354 on the rod 350 may be located in the limiting trench 3242 on the hollow protrusion 3241 of the driving head 320, such that the rod 350 may be prevented from deviating during the rotation process, and the deviation may cause that the fifteenth abutting surface 3521 on the pushing block 352 of the rod 350 may not be abutted against the seventh abutting surface 3265 on the transmission rod 326 of the driving head 320. The fifteenth abutting surface 3521 and the seventh abutting surface 3265 on the driving head may both be inclined toward the direction away from the toner cartridge body along the length direction of the toner cartridge body, such that the abutting may be easier, the transmission rod 326 on the driving head 320 may be more easily deformed, and the free end of the transmission rod 326 may be more easily snapped on the protruding eave 313.

In the existing technology, the fixing protrusion 312 of the connecting portion 310 may be abutted against the transmission rod 326 of the driving head 320, thereby transmitting the rotational driving force from the driving head 320 to the connecting portion 310. In the present disclosure, the fixing protrusion 312 of the connecting portion 310 may be connected to the stopper 330 and the transmission rod 326 on the driving head 320 may be abutted against the transmission hole 333 on the stopper 330, thereby transmitting the rotational driving force from the driving head 320 to the stopper 300, and then from the stopper 300 to the connecting portion 310.

When the force receiving part, after being assembled, is installed on the toner cartridge body, as shown in FIG. 21 and FIG. 22, the first abutting surface 311 of the connecting portion 310 may be abutted against the eighth abutting surface 328 on the driving head 320, the third abutting surface 3251 on the limiting protrusion 325 of the driving head 320 may be abutted against the ninth abutting surface 3321 on the blocking portion 332 of the stopper 330, and the fifteenth abutting surface 3521 on the pushing block 352 of the rod 350 may be abutted against the seventh abutting surface 3265 on the transmission rod 326 of the driving head 320. The protruding eave 313 of the connecting portion 310 may be abutted against the fourth abutting surface 3262 on the transmission rod 326 of the driving head 320. The two ends of the first elastic element 361 may be respectively connected to the rod cap 354 of the rod 350 and the thirteenth abutting surface 345 on the moving element 340, and the two ends of the second elastic element 362 may be respectively connected between the fourteenth abutting surface 346 on the moving element 340 and the tenth abutting surface 336 on the stopper 330. Obviously, the two ends of the first elastic element and the second elastic element may also use the abutting manner. Optionally, the third elastic element may also be disposed and the two ends of the third elastic element may be respectively connected to the eleventh abutting surface 337 on the stopper 330 and the connecting rod 353 of the rod 350. The transmission rod 326 of the driving head 320 may pass through the transmission hole 333 on the stopper 330 and may drive the stopper 330 and the connecting portion 310 to rotate jointly when the driving head rotates. The connecting rod 342 of the moving element 340 may be located in the guide trench 327 on the driving head and pass through the guide hole 3271. The fixing trench 3311 on the fixing portion 331 of the stopper 330 may be connected to the fixing protrusion 312 of the connecting portion 310, such that the stopper 330 may be fixed on the connecting portion 310. The rod 350 may sequentially pass through the first limiting hole 324 on the driving head 320, the second limiting hole 335 on the stopper 330, and the third limiting hole 344 on the moving element 340. At this point, the second elastic element 362 may tend to push the driving head away from the direction of the toner cartridge, which is a first position of the force receiving part, and at this point, the entire toner cartridge may be in a sealed state, and the developer in the toner cartridge may be isolated from the outside.

When the toner cartridge is installed in the image forming device and the toner is ready to flow out, the needle device in the rotational driving force transmission part of the image forming device may be abutted against the sixteenth abutting surface 3541 on the rod cap 354 of the rod 350 and may push the rod 350 to move along the direction away from the image forming device during the installation process. At this point, the fifteenth abutting surface 3521 on the pushing block 352 of the rod 350 may be separated from the seventh abutting surface 3265 on the transmission rod 326 of the driving head 320, such that the fourth abutting surface 3262 on the elastic transmission rod 326 may be separated from the protruding eave 313 of the connecting portion 310. Since the second elastic element 362 is in a compressed state, the second elastic element 362 may drive the driving head 320 and the moving element 340 to move along the direction away from the toner cartridge body, thereby separating the first abutting surface 311 on the connecting portion 310 from the eighth abutting surface 328 on the driving head 320 and generating a toner outlet for flowing out the toner between the first abutting surface 311 on the connecting portion 310 and the eighth abutting surface 328 on the driving head 320; the developer in the toner cartridge body may be transported to the vicinity of the toner outlet through the through hole 334 on the stopper 330, thereby transporting the developer to the image forming device; and at this point, the force receiving part is at a second position. The pushing device of the rotational driving force transmission part of the image forming device may be abutted against the twelfth abutting surface 341 on the moving element 340 and enable the moving element 340 to move along the direction toward the toner cartridge body. Then, the moving element 340 may return to the second position of the force receiving part. The driving tooth 321 of the driving head may obtain the rotational driving force from the rotational driving force transmission part, then the force is transmitted to the stopper 330 through the fixing rod 322 and the transmission rod 326 of the driving head 120 and then to the connecting portion 310, and finally drive the toner cartridge body to move jointly.

When the image forming device stops the image formation and the toner cartridge is read to be uninstalled, the pushing device of the rotational driving force transmission part of the image forming device may be abutted against the twelfth abutting surface 341 on the moving element 340 and enable the moving element 340 to move along the direction toward the toner cartridge body. The free end 3431 of the pushing rod 343 of the moving element 340 may be abutted against the sixth abutting surface 3264 on the transmission rod 326 of the driving head 320, and the driving head 320 and the moving element 340 may move along the direction toward the toner cartridge. When the eighth abutting surface 328 on the driving head 320 is abutted against the first abutting surface 311 on the connecting portion 310, the moving element 340 may continue to move along the direction toward the toner cartridge. As the moving element 340 continues to move, the fourth abutting surface 3262 on the transmission rod 326 of the driving head 320 may be abutted against the protruding eave 313 of the connecting portion 310. When the moving element 340 continues to move, the entire toner cartridge may move along the direction away from the rotational driving force transmission part, and the rod 350, relative to the toner cartridge, may move along the direction toward the rotational driving force transmission part, thereby returning the force receiving part to the first position.

The moving range of the driving head 320 may be restricted by the third abutting surface on the limiting protrusion 325 of the driving head 320 and the ninth abutting surface on the blocking portion 332 of the stopper 330. The moving range of the moving element 340 may be restricted by the fourteenth abutting surface 346 on the moving element 340 and the tenth abutting surface 336 on the stopper 330.

Optionally, the second elastic element 362 and the third elastic element 363 may be two ends of a spring mounted on the stopper 330; only the first elastic element 361 or the third elastic element 363 may be disposed to save costs, and both the first elastic element and the third elastic element may be disposed to ensure the part stability; and a sealing part may be disposed between the first abutting surface 311 on the connecting portion 310 and the eighth abutting surface on the driving head 320.

The Sixth Embodiment

The force receiving part in one embodiment is substantially same as the force receiving part in the fifth embodiment, and the only difference is that an abutting block 347 and a support rod 348 may be disposed on the moving element 340 in one embodiment.

Figure 31:
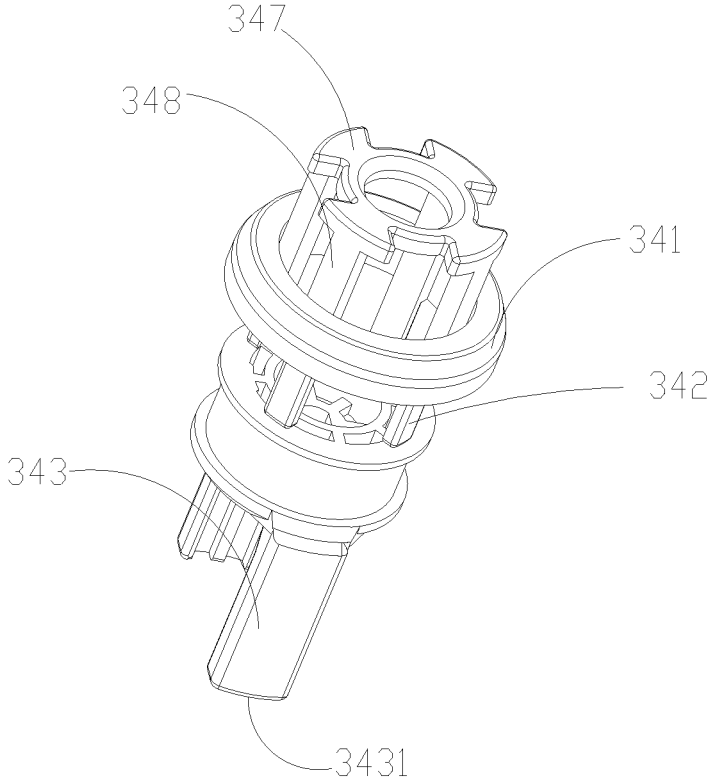
FIG. 31 illustrates a stereoscopic view of a moving element in the sixth embodiment.

As shown in FIG. 31, the support rod 348 may also be disposed on another side of the connecting rod 342 opposite to the twelfth abutting surface 341. The abutting block 347 may also be disposed on the free end of the support rod 348. The support rod 348 and the abutting block 347 may extend on the force receiving part along the direction away from the toner cartridge body.

Figure 32:
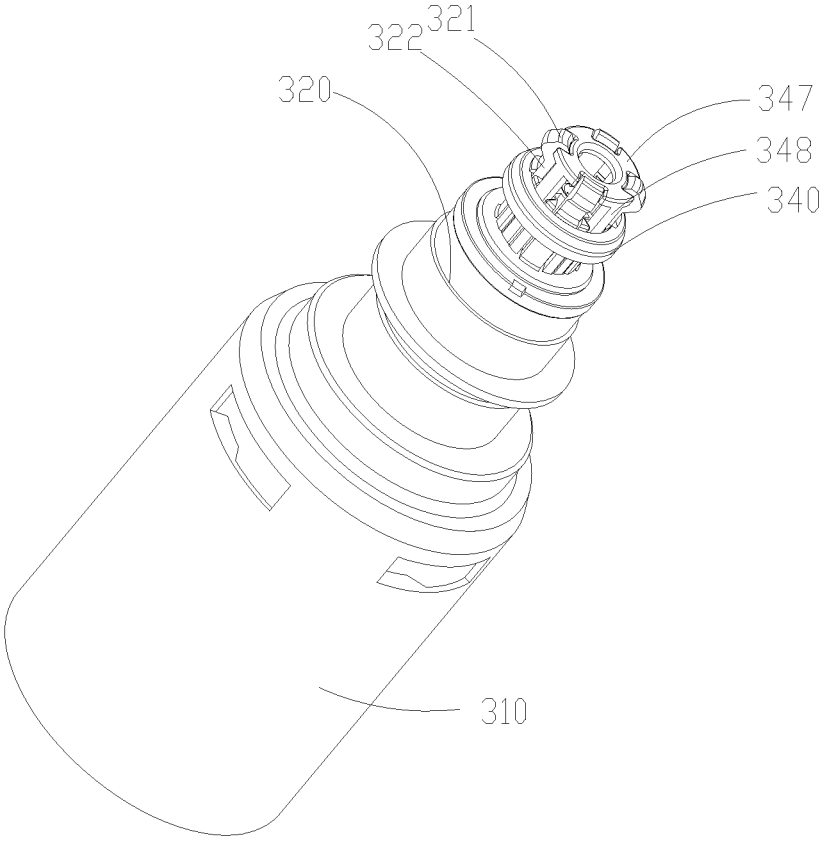
FIG. 32 illustrates a stereoscopic view of a force receiving part in the sixth embodiment.

As shown in FIG. 32, when the moveable portion 340 is located on the force receiving part, the abutting block 347 may be abutted against the side of the fixing rod 322 adjacent to the driving tooth 321, such that the driving tooth 321 may not cause the fixing rod 322 to be inwardly deviated from the radial direction of the rotating axis of the force receiving part due to the interference with the image forming device, thereby affecting the transmission of the rotational driving force.

The Seventh Embodiment

The working principle of the force receiving part in one embodiment is the same as the working principle of the force receiving part in the sixth embodiment, and the only difference is that the shape of the moving part 340 in one embodiment may be slightly different from the shape of the moving part in the sixth embodiment.

Figure 33:
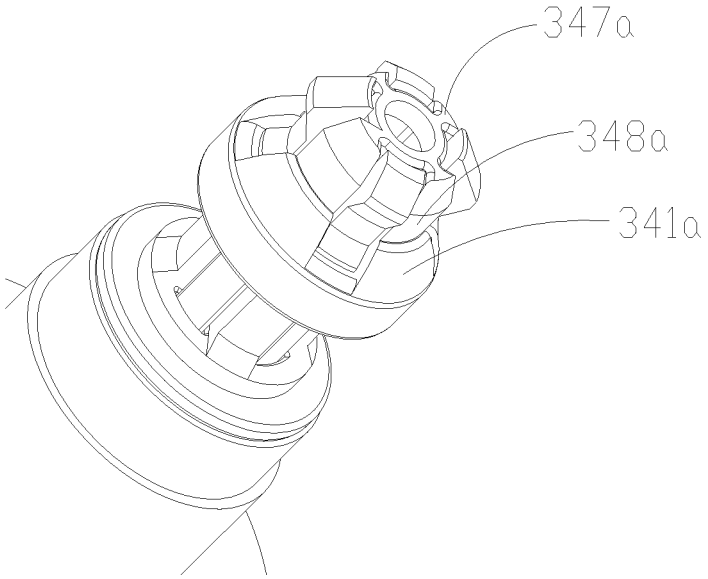
FIG. 33 illustrates a stereoscopic view of a force receiving part in the seventh embodiment.

As shown in FIG. 33, in one embodiment, the twelfth abutting surface 341*a* may be an inclined surface which is not perpendicular to the rotating axis of the force receiving part, and the point on the twelfth abutting surface 341*a* which is farther from the toner cartridge body is closer to the rotating axis of the force receiving part. The support rod 348*a* may be located at the position of the twelfth abutting surface 341*a* which is closest to the rotating axis of the force receiving part and may protrude along the direction away from the toner cartridge body, and the support rod 348*a* may support the abutting block 347*a*. The support rod 348*a* and the abutting block 347*a* may have same functions as the sixth embodiment.

Due to the gravity and errors in long-term abrasion and transmission, the rotating axis of the rotational driving force transmission part may not be coaxial with the rotating axis of the force receiving part and small error may be between the two rotating axes. Therefore, compared with the force receiving part in the sixth embodiment, the force receiving part in one embodiment may not be jammed due to the interference when the force receiving part rotates into the image forming device. However, compared with the force receiving part in the sixth embodiment, the design in one embodiment may have higher cost of production and modification.

The Eighth Embodiment

In order to further facilitate the production and solve the assembly difficulty during the actual production process and long required labor hours for reassignment, the shapes and structures of the parts may be further improved in one embodiment, based on other above-mentioned embodiments. However, the principle of the entire force receiving part is the same as the principle of the force receiving part in the fifth embodiment.

Figure 34:
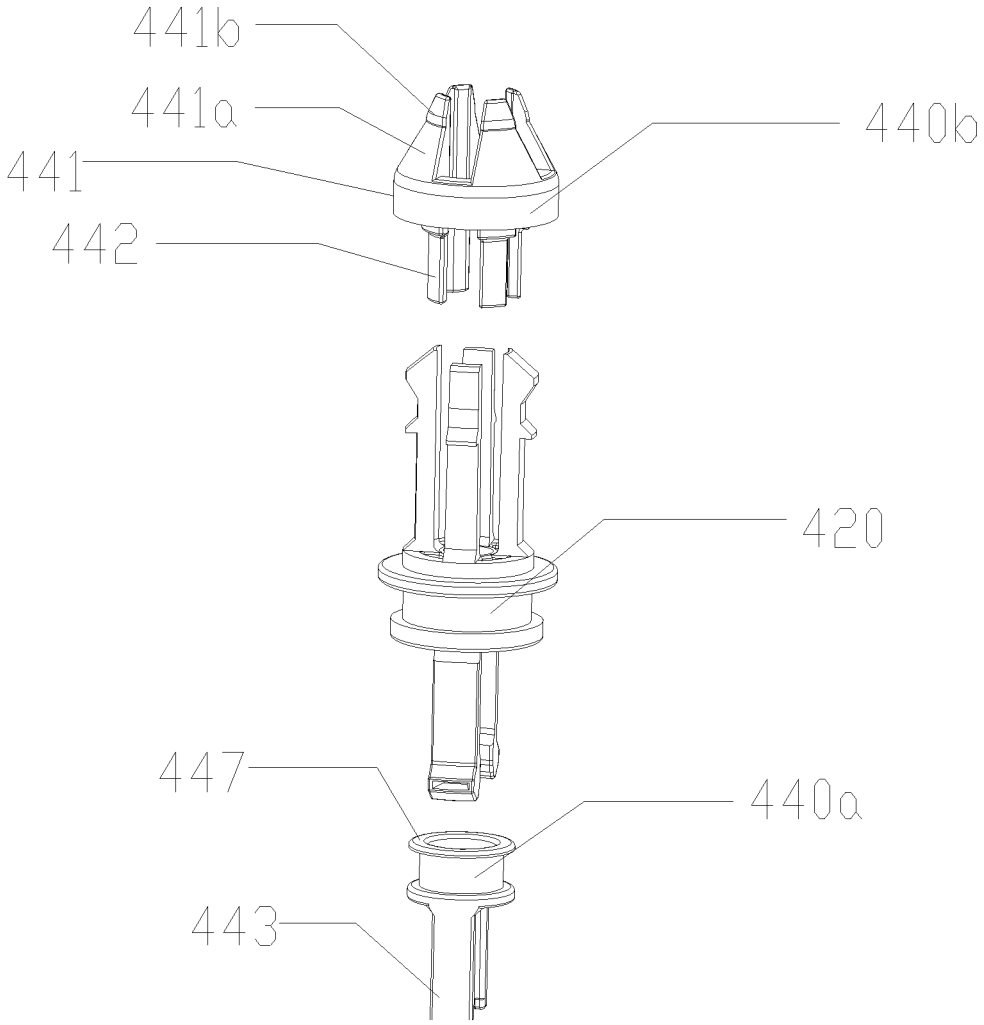
FIG. 34 illustrates a structural exploded view of a first moving element, a second moving element, and a driving head in the eighth embodiment.
Figure 35:
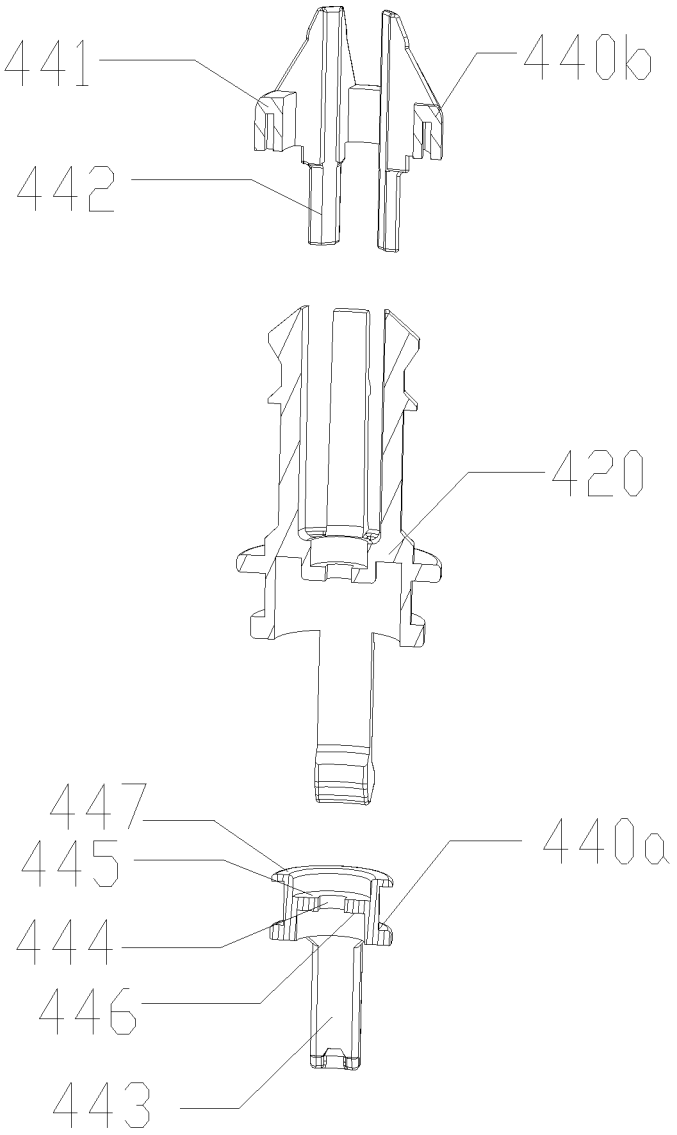
FIG. 35 illustrates a cross-sectional view of a first moving element, a second moving element, and a driving head of being cut along the rotating axis of the force receiving part in the eighth embodiment.
Figure 36:
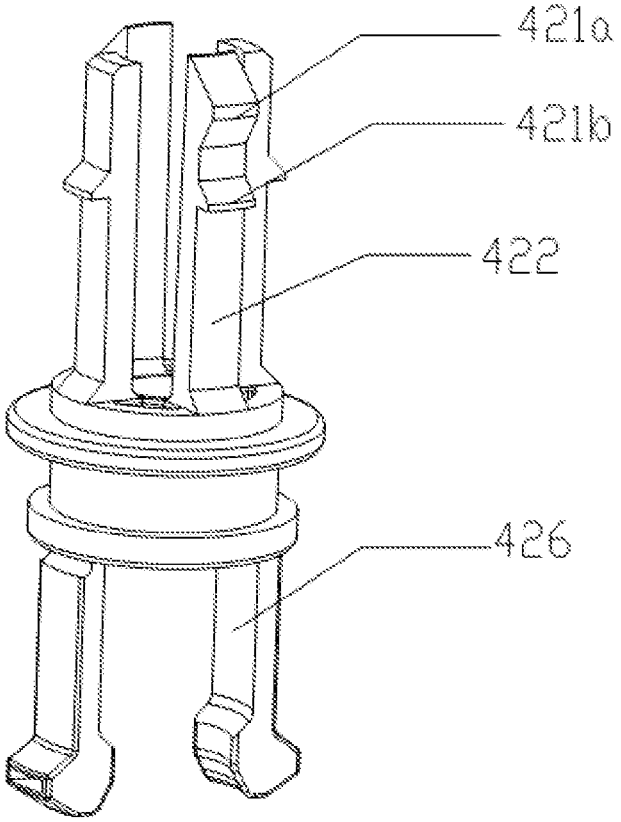
FIG. 36 illustrates a stereoscopic view of a driving head in the eighth embodiment.

As shown in FIGS. 34-36, compared with the fifth embodiment, the force receiving part involved in one embodiment may mainly have the following modifications.

1) Compared with the moving element 340 in the fifth embodiment, the moving element may be divided into a first moving element 440*a* and a second moving element 440*b* in one embodiment, as shown in FIG. 34 and FIG. 35. FIG. 34 illustrates a structural exploded view of the first moving element 440*a*, the second moving element 440*b*, and the driving head 420; and FIG. 35 illustrates a cross-sectional view of parts in FIG. 34 being cut along the rotating axis of the force receiving part. One end of the second moving element 440*b* may be abutted against the one end of the first moving element 440*a*, the other end of the second moving element 440*b* may be abutted against the image forming device, and the other end of the first moving element 440*a* may be abutted against the driving head 420. In one embodiment, the connecting rod 442 on the second moving element may be abutted against the first moving element 440*a*. Such design may be mainly to facilitate assembly, such that the first moving element 440*a* and the second moving element 440*b* may be installed with corresponding reference from both sides. Obviously, the first moving element 440*a* may not be disengaged due to the restriction of the rod 350 and the driving head 420. For example, in one embodiment, the structure of the first moving element 440*a* may be basically the lower half of the moving element 340 in the fifth embodiment and include the pushing rod 443, the third limiting hole 444, the thirteenth abutting surface 445 and the fourteenth abutting surface 446. The pushing rod 443, the third limiting hole 444, the thirteenth abutting surface 445 and the fourteenth abutting surface 446 may all have the same structures and functions as the pushing rod 343, the third limiting hole 344, the thirteenth abutting surface 345 and the fourteenth abutting surface 346 in the fifth embodiment; and the rod 350 may pass through the third limiting hole 444, which may not be limited in detail herein. The second moving element 440*b* may have a ring-shaped support block 441, and the rod 350 may pass through the inside of the ring formed by the support block 441. The connecting rod 442 may protrude from the support block 441 along the direction of the toner cartridge body. In one embodiment, the connecting rod 442 may be located between two adjacent fixing rods 422, and the two adjacent fixing rods 422 may restrict the position of the connecting rod 442, which may be similar to the effect of the guide trench 327 in the fifth embodiment. A guide surface 441*a* and a contact end 441*b* may sequentially extend from the support block 441 along the direction away from the toner cartridge body. The guide surface 441*a* and the contact end 441*b* may be abutted against the image forming device. Optionally, the quantity of the connecting rods may be four, and the quantities of the guide surfaces 441*a* and the contact ends 441*b* may be respectively four; the connecting rods 442, the guide surfaces 441*a* and the contact ends 441*b* may be in one-to-one correspondence with respect to the support blocks 441. When the second moving element 440*b* is pushed by the image forming device to move along the direction toward the toner cartridge body, the connecting rod 442 may be abutted against the first moving element 440*a* and drive the first moving element 440*a* to move along the direction toward the toner cartridge body. Optionally, the connecting rod 442 may be abutted against the seventeenth abutting surface 447 of the first moving element 440*a* closest to the second moving element 440*b*. The seventeenth abutting surface 447 may be disposed at the side away from the toner cartridge body, the fourteenth abutting surface 446 may be disposed at the side adjacent to the toner cartridge body, the seventeenth abutting surface 447 and the fourteenth abutting surface 446 may be disposed at opposite directions, and the seventeenth abutting surface 447 may be an annular surface. Such design may not only make the installation process simpler, but also make the part manufacturing process simpler. The fourteenth abutting surface 446 in one embodiment may have the similar function as the fourteenth abutting surface 446 in the fifth embodiment. However, compared with the fourteenth abutting surface 446 in the fifth embodiment, a ring-shaped protrusion may be disposed around the fourteenth abutting surface 446 in one embodiment, which may prevent the elastic element from deviating during the production and assembly process to affect production efficiency.

2) Compared with the fifth embodiment where the twelfth abutting surface 341 is abutted against the image forming device, the second moving element 440*b* may include the support block 441 in one embodiment, the guide surface 441*a* and the contact end 441*b* may sequentially extend from the support block 441 along the direction away from the toner cartridge body, as shown in FIG. 34. The radius of the imaginary circle enclosed by the contact ends 441*b* may be smaller than the radius of the circle enclosed by the support block 441, that is, the distance between the contact end 441*a* and the rotating axis of the force receiving part may be smaller than the distance between the support block 441 and the rotating axis of the force receiving part. Therefore, the farther the guide surface 441*a* is away from the toner cartridge body, the smaller the distance from the rotating axis of the force receiving part to the guide surface 441*a* is. Such design may enable the second moving element 441*b* to be better abutted against the rotational driving force transmission part of the image forming device during the processing of installing the toner cartridge on the image forming device; and since the rotating axis (i.e., the coaxial rotating axis of the toner cartridge) of the force receiving part and the rotating axis of the rotational driving force transmission part on the image forming device cannot be coaxial due to the abrasion of long period use time, the jamming caused by the collision of the rotating axes in the image forming device during the installation of the toner cartridge may be prevented to affect the normal operation of the image forming device.

3) Compared with the fifth embodiment where the limiting protrusion 325 is abutted against the blocking portion 332, the limiting protrusion may be deleted in the force receiving part in one embodiment, and the transmission rod 426 may be directly used to pass through the transmission hole 333 and may be abutted against the hole wall of the transmission hole 333, as shown in FIG. 36, which may reduce the complexity of the part structures and costs. Obviously, the blocking portion 332 may not be disposed on the stopper 330. The stopper 330 disposed with the blocking portion 332 in the fifth embodiment may also be completely applied to the force receiving part in one embodiment, but the blocking portion 332 may no longer function and the materials may be compatible, thereby achieving the purpose of saving the number of molding and reducing costs. Meanwhile, in order to reduce the processing difficulty, the hollow protrusion 3241 may no longer be disposed to restrict the rod 350, and only the rod 350 may be installed inside the structure enclosed by the fixing rods 322.

4) Compared with the fifth embodiment where the fixing rod 322 supports the driving tooth 321, four fixing rods 422 may be disposed in one embodiment, where the driving teeth 421*a* may be disposed on two symmetrical fixing rods 422 relative to the rotating axis of the force receiving part, and the driving teeth 421*a* may not be disposed on two symmetrical fixing rods 422 relative to the rotating axis of the force receiving part, as shown in FIG. 36. In one embodiment, the connection line between two fixing rods 422 disposed with the driving teeth 421*a* may be orthogonal to the connection line between two fixing rods 422 without the driving teeth 421*a*. Obviously, other quantities of the fixing rods 422 and the driving teeth 421*a* may also be disposed, but at least two fixing rods 422 having the driving teeth 421*a* should be included. Limiting teeth 421*b*, which may prevent the disengagement of the second moving element 440*a*, may also be disposed on the fixing rods 422. Obviously, the limiting teeth 421*b* may also be disposed on a part of the fixing rods 422, but at least two fixing rods 422 should include the limiting teeth 421*b*. In an actual transmission process, the limiting teeth 421*b* may not participate in the process, and the only function of the limiting teeth 421*b* in one embodiment may prevent the disengagement of the second moving element 440*a*. Compared with the fifth embodiment, fewer driving teeth in one embodiment may make the engagement process smoother, and further reduce the engagement difficulty caused by the interference between the driving teeth and the image forming device.

Finally, it should be noted that the above-mentioned embodiments may be merely used to describe the technical solution of the present disclosure, rather than limiting the present disclosure. Although the present disclosure has been described in detail with reference to the above-mentioned embodiments, those skilled in the art should understand that the technical solutions described in the above-mentioned embodiments may still be modified, or a part or all of the technical features may be equivalently replaced. Such modifications or replacements do not make the essence of the corresponding technical solutions outside the scope of the technical solutions of the embodiments of the present disclosure.

INDUSTRIAL APPLICABILITY

The force receiving part and the toner cartridge provide in the embodiments of the present application may avoid the situation where the driving tooth structure of the toner cartridge and the internal engagement of the image forming device are locked in the existing technology, also reduce the possibility of errors in the operation of the machine and improve the tightness of the machine, and further effectively prevent the developer in the toner cartridge from leaking which may pollute the environment and affect the image forming quality.

What is claimed is:

1. A force receiving part, used for a toner cartridge that includes a toner cartridge body and is detachably installed on an image forming device, the force receiving part comprising:

a receiving element, including a receiving tooth, a support rod, and a transmission rod, and being capable of engaging with the image forming device, wherein:

the receiving tooth is configured to receive a force from the image forming device;

the support rod is capable of inwardly deviating along a radial direction of a rotating axis of the toner cartridge body, wherein the receiving tooth is disposed at a free end of the support rod; and the transmission rod is capable of transmitting the force received by the receiving tooth from the image forming device to the toner cartridge body; and a moving element, capable of moving relative to the support rod, wherein during a moving process of the moving element relative to the support rod, in at least one position the support rod is interacted with the moving element and the receiving element is unable to disengage from the image forming device.

2. The part according to claim 1, wherein:

during the moving process of the moving element relative to the support rod, the support rod is unable to inwardly deviate along the radial direction of the rotating axis of the toner cartridge body in at least one position under action of the moving element.

3. The part according to claim 1, wherein:

an elastic element is disposed between the moving element and the receiving element;

the moving element includes an abutting portion and a pushing portion;

the image forming device is abutted against the pushing element and pushes the moving element to move along a direction of the rotating axis of the toner cartridge body; and the pushing element is abutted against the support rod.

4. The part according to claim 3, wherein:

an anti-detachment trench is disposed on the support rod;

the pushing element is located inside the anti-detachment trench; and the anti-detachment trench is capable of preventing the moving element from detaching from the force receiving part when the moving element moves relative to the support rod.

5. The part according to claim 1, wherein:

the transmission rod is rigidly connected to the support rod; the force receiving part includes a transmission element; and the transmission element is connected to the toner cartridge body and abutted against the transmission rod, such that the transmission rod is capable of transmitting the force received by the receiving tooth from the image forming device to the toner cartridge body.

6. The part according to claim 5, wherein:

a locking tooth is disposed on the transmission rod to prevent the receiving element from being detached and separated from the transmission element.

7. The part according to claim 1, wherein:

the force receiving part includes an elastic element which enables the support rod to be inwardly deviated relative to the radial direction of the rotating axis of the toner cartridge body.

8. The part according to claim 7, wherein:

the elastic element is a ring-shaped elastic element and abutted against the receiving tooth.

9. The part according to claim 1, wherein:

the moving element includes a first moving element and a second moving element, and the first moving element and the second moving element are independent from each other.

10. A force receiving part, used for a toner cartridge that includes a toner cartridge body, the force receiving part comprising:

a connecting portion, configured for connecting with the cartridge body;

a driving head, wherein one end of the driving head is configured to receive a force from an image forming device and the other end of the driving head is configured to transmit the force to the connecting portion;

a rod, wherein the rod is capable of moving along a length direction of the toner cartridge body and one end of the rod along the length direction of the toner cartridge body is abutted against the driving head to fix the driving head relative to the connecting portion;

wherein the force receiving part further includes a second elastic element; one end of the second elastic element is connected to the connecting portion and the other end of the second elastic element is connected to the driving head; when the force receiving part is in a first position, the second elastic member has a tendency to push the driving head away from the toner cartridge body; and the force receiving part is any one of three structures, wherein:

1) the force receiving part further includes a first elastic element, wherein one end of the first elastic element is connected to the driving head and the other end of the first elastic element is connected to the rod;

2) the force receiving part further includes a third elastic element, wherein one end of the third elastic element is connected to the connecting portion and the other end of the third elastic element is connected to the rod; and 3) the force receiving part further includes the first elastic element and the third elastic element, wherein one end of the first elastic element is connected to the driving head and the other end of the first elastic element is connected to the rod; and one end of the third elastic element is connected to the connecting portion and the other end of the third elastic element is connected to the rod.

11. The part according to claim 10, wherein:

the force receiving part further includes a stopper, wherein the stopper is connected to the connecting portion; a transmission hole is further disposed at the stopper; one end of the second elastic member is connected to the driving head and the other end is connected to the stopper; and one end of the third elastic member is connected to the rod and the other end is connected to the stopper.

12. The part according to claim 10, wherein:

the force receiving part further includes a moving element, wherein one end of the moving element is configured to be abutted against the image forming device and the other end of the moving element is configured to be abutted against the driving head; and when the image forming device pushes the moving element to move toward the toner cartridge body, the moving element is capable of driving the driving head to move toward the toner cartridge body.

13. The part according to claim 12, wherein:

the moving element includes an abutting surface and a connecting rod;

a structure including the abutting surface is connected through the connecting rod;

a support rod is disposed on a side of the connecting rod opposite to the abutting surface;

an abutting block is further disposed on a free end of the support rod, and the support rod and the abutting block extend on the force receiving part along a direction away from the toner cartridge body;

the abutting surface is an inclined surface which is not perpendicular to a rotating axis of the force receiving part, and a point on the abutting surface which is farther from the toner cartridge body is closer to the rotating axis of the force receiving part;

the support rod is located at a position of the abutting surface which is closest to the rotating axis of the force receiving part and protrudes along the direction away from the toner cartridge body, and the support rod supports the abutting block.

14. The part according to claim 12, wherein:

the moving element includes a first moving element and a second moving element; one end of the second moving element is abutted against one end of the first moving element, the other end of the second moving element is configured to be abutted against the image forming device, and the other end of the first moving element is abutted against the driving head.

15. The part according to claim 14, wherein:

the second moving element has a ring-shaped support block; a guide surface and a contact end sequentially extend from the support block along a direction away from the toner cartridge body; the guide surface and the contact end is abutted against the image forming device; a radius of an imaginary circle enclosed by the contact ends is smaller than a radius of a circle enclosed by the support block; the farther the guide surface is away from the toner cartridge body, the smaller the distance from the rotating axis of the force receiving part to the guide surface is.

16. The part according to claim 10, wherein:

the rod further includes a pushing block which is configured to be abutted against the driving head; a first abutting surface is disposed on an end of the pushing block adjacent to the image forming device along the length direction of the toner cartridge body; the first abutting surface is inclined toward a direction away from the toner cartridge body along the length direction of the toner cartridge body; a second abutting surface is disposed on a free end of the driving head adjacent to the toner cartridge body and is inclined toward the direction away from the toner cartridge body; and the first abutting surface is abutted against the second abutting surface.

17. The part according to claim 10, wherein:

a driving tooth is disposed on one end of the driving head for receiving the force from the image forming device, and a side surface of the driving teeth adjacent to the direction of the toner cartridge body is inclined toward the direction of the toner cartridge body along the length direction of the toner cartridge body.

18. The part according to claim 17, wherein:

a fixing rod is disposed on the driving head, the driving tooth is disposed on the fixing rod, and at least two fixing rods are disposed with driving teeth.

19. A toner cartridge, comprising:

a force receiving part, used for a toner cartridge that includes a toner cartridge body and is detachably installed on an image forming device, the force receiving part comprising:

a receiving element, including a receiving tooth, a support rod, and a transmission rod, and being capable of engaging with the image forming device, wherein:

the receiving tooth is configured to receive a force from the image forming device;

the support rod is capable of inwardly deviating along a radial direction of a rotating axis of the toner cartridge body, wherein the receiving tooth is disposed at a free end of the support rod; and the transmission rod is capable of transmitting the force received by the receiving tooth from the image forming device to the toner cartridge body; and a moving element, capable of moving relative to the support rod, wherein during a moving process of the moving element relative to the support rod, in at least one position the support rod is interacted with the moving element and the receiving element is unable to disengage from the image forming device.

* * * * *